US005890996A

United States Patent [19]

Frame et al.

[11] Patent Number: 5,890,996

[45] Date of Patent: Apr. 6, 1999

[54] EXERCISER AND PHYSICAL PERFORMANCE MONITORING SYSTEM

[75] Inventors: John M. Frame; H. Graeme French; Howard P. Davis, all of Pullman, Wash.

[73] Assignee: Interactive Performance Monitoring, Inc., Pullman, Wash.

[21] Appl. No.: 652,709

[22] Filed: May 30, 1996

[51] Int. Cl.[6] ..... A63B 21/008

[52] U.S. Cl. ..... 482/8; 482/111; 482/112; 482/113

[58] Field of Search ..... 482/1–9, 51–53, 482/58, 59, 63, 70–73, 92, 111–113

[56] References Cited

U.S. PATENT DOCUMENTS

| | | |
|---|---|---|
| Re. 34,212 | 4/1993 | Potts . |
| 3,387,843 | 6/1968 | Chandler . |
| 3,675,640 | 7/1972 | Gatts . |
| 3,758,112 | 9/1973 | Crum et al. . |
| 3,822,599 | 7/1974 | Brentham . |
| 3,970,302 | 7/1976 | McFee . |
| 4,063,726 | 12/1977 | Wilson . |
| 4,192,000 | 3/1980 | Lipsey . |
| 4,235,437 | 11/1980 | Ruis et al. . |
| 4,257,593 | 3/1981 | Keiser . |
| 4,408,183 | 10/1983 | Wills . |
| 4,468,025 | 8/1984 | Sferle . |
| 4,566,692 | 1/1986 | Brentham . |
| 4,571,682 | 2/1986 | Silverman et al. . |
| 4,572,500 | 2/1986 | Weiss . |
| 4,601,468 | 7/1986 | Bond et al. . |
| 4,609,190 | 9/1986 | Brentham . |
| 4,625,960 | 12/1986 | Gvoich et al. . |
| 4,627,610 | 12/1986 | Ishida et al. . |
| 4,642,769 | 2/1987 | Petrofsky . |
| 4,647,039 | 3/1987 | Noffsinger . |
| 4,687,195 | 8/1987 | Potts . |
| 4,691,694 | 9/1987 | Boyd et al. . |
| 4,705,271 | 11/1987 | Mondloch et al. . |
| 4,746,115 | 5/1988 | Lahman . |
| 4,750,735 | 6/1988 | Furgerson et al. . |
| 4,785,674 | 11/1988 | Orman et al. . |
| 4,799,676 | 1/1989 | Sheppard et al. . |
| 4,817,940 | 4/1989 | Shaw et al. . |
| 4,828,257 | 5/1989 | Dyer et al. . |
| 4,840,372 | 6/1989 | Oglesby et al. . |
| 4,840,634 | 6/1989 | Muller et al. . |
| 4,842,268 | 6/1989 | Jenkins . |
| 4,842,274 | 6/1989 | Oosthuizen et al. . |
| 4,846,458 | 7/1989 | Potts . |
| 4,865,315 | 9/1989 | Paterson et al. . |
| 4,869,497 | 9/1989 | Stewart et al. . |
| 4,872,668 | 10/1989 | McGillis et al. . |

(List continued on next page.)

OTHER PUBLICATIONS

Biodex Medical brochure, *The Biodex Semi–Recumbent Cycle;* 7 pages.

Davis, Paul O; *The Keiser Manual;* 1989; pp. 6–0 through 6–21.

*Primary Examiner*—Glenn E. Richman

*Attorney, Agent, or Firm*—Wells, St. John, Roberts, Gregory & Matkin, P.S.

[57] ABSTRACT

A combined exerciser and physical fitness performance monitoring apparatus and related methods. The apparatus includes at least one fluid working device, such as a pneumatic ram, which serves to provide an adjustable load. The fluid working device is movable using an adjustable mount to vary the compression ratio and loading rate. The fluid working device is connected to a user interface, such as foot pedals or hand holds, using a connection linkage. The apparatus also preferably includes a load modifier which adjustably engages the connection linkage and allows the rate of mechanical loading to be varied. This construction allows a large range of loads and force rates to be achieved.

25 Claims, 13 Drawing Sheets

U.S. PATENT DOCUMENTS

| | | |
|---|---|---|
| 4,919,418 | 4/1990 | Miller . |
| 4,928,957 | 5/1990 | Lanier et al. . |
| 4,930,770 | 6/1990 | Baker . |
| 4,932,650 | 6/1990 | Bingham et al. . |
| 4,976,426 | 12/1990 | Szabo et al. . |
| 4,978,303 | 12/1990 | Lampbell . |
| 5,005,140 | 4/1991 | Havriluk . |
| 5,011,142 | 4/1991 | Eckler . |
| 5,018,726 | 5/1991 | Yorioka . |
| 5,020,795 | 6/1991 | Airy et al. . |
| 5,026,046 | 6/1991 | DeCloux . |
| 5,027,303 | 6/1991 | Witte . |
| 5,046,484 | 9/1991 | Bassett et al. . |
| 5,054,774 | 10/1991 | Belsito . |
| 5,058,882 | 10/1991 | Dalebout et al. . |
| 5,058,887 | 10/1991 | Patterson . |
| 5,067,710 | 11/1991 | Watterson et al. . |
| 5,104,119 | 4/1992 | Lynch . |
| 5,114,389 | 5/1992 | Brentham . |
| 5,129,450 | 7/1992 | Hung . |
| 5,139,470 | 8/1992 | Wang . |
| 5,147,263 | 9/1992 | Mueller . |
| 5,169,361 | 12/1992 | Hsu . |
| 5,178,160 | 1/1993 | Gracovetsky et al. . |
| 5,178,599 | 1/1993 | Scott . |
| 5,180,353 | 1/1993 | Snyderman . |
| 5,183,449 | 2/1993 | DeCloux . |
| 5,207,621 | 5/1993 | Koch et al. . |
| 5,209,714 | 5/1993 | Sainte et al. . |
| 5,209,715 | 5/1993 | Walker et al. . |
| 5,230,672 | 7/1993 | Brown et al. . |
| 5,254,066 | 10/1993 | Brown et al. . |
| 5,261,867 | 11/1993 | Chen . |
| 5,277,682 | 1/1994 | Chen . |
| 5,308,296 | 5/1994 | Eckstein . |
| 5,308,300 | 5/1994 | Chino et al. . |
| 5,312,315 | 5/1994 | Mortensen et al. . |
| 5,314,390 | 5/1994 | Westing et al. . |
| 5,318,490 | 6/1994 | Henderson et al. . |
| 5,334,120 | 8/1994 | Rasmussen . |
| 5,346,452 | 9/1994 | Ku . |
| 5,370,592 | 12/1994 | Wu . |
| 5,387,164 | 2/1995 | Brown, Jr. . |
| 5,397,287 | 3/1995 | Lindfors . |
| 5,401,224 | 3/1995 | Tsuchiya et al. . |
| 5,403,257 | 4/1995 | Lehtonen . |
| 5,407,402 | 4/1995 | Brown et al. . |
| 5,410,472 | 4/1995 | Anderson . |
| 5,421,798 | 6/1995 | Bond et al. . |
| 5,435,799 | 7/1995 | Lundin . |
| 5,437,587 | 8/1995 | Prince et al. . |
| 5,458,548 | 10/1995 | Crossing et al. . |
| 5,462,503 | 10/1995 | Benjamin et al. . |
| 5,469,740 | 11/1995 | French et al. . |
| 5,474,512 | 12/1995 | Belfry . |
| 5,484,358 | 1/1996 | Wang et al. . |
| 4,884,445 | 12/1989 | Sadoff et al. . |
| 4,889,108 | 12/1989 | Bond et al. . |
| 4,911,436 | 3/1990 | Lighter . |
| 4,912,638 | 3/1990 | Pratt, Jr. . |

EXERCISER AND PHYSICAL PERFORMANCE MONITORING SYSTEM

TECHNICAL FIELD

The present invention relates to apparatuses for physical exercise, and in particular combined exercisers and physical performance monitoring systems having the ability to provide a variety of different force loadings and rates of force loading.

BACKGROUND OF THE INVENTION

Physical exercise, therapy and rehabilitation contain a wide variety of apparatus directed at various specific muscle groups and special purpose applications. Many of the exercise machines are directed solely to the objective of providing the user with a workout of certain muscle groups. This is typically done with the goal being to develop certain physical aspects, for example, leg muscles, arm muscles, or general cardiovascular stamina.

There has also been somewhat different development in the area more properly considered physical therapy and/or physical rehabilitation machines. Rather than merely emphasizing development of muscles and general overall physical endurance, these more specialized machines monitor the performance of the user. Such physical monitoring machines may also be programmed to provide a certain level of force or resistance to a user in an effort to achieve a desired effect on the user. For example, in U.S. Pat. No. 5,421,798, to Bond et al. describes a system which can be programmed to apply a predetermined load to the limb of a user of the apparatus. The apparatus of Bond is further provided with instrumentation to determine certain kinematics and kinetics of the user while using the apparatus.

Another example is provided in U.S. Pat. No. 5,401,224 Tsuchiya et al. which describes a method for measuring instantaneous leg power generated by the user of a physical therapy apparatus. Tsuchiya et al. provide for a display to communicate to the user the final measurement of the power generated by the user.

Despite these approaches there are a number of limitations in the art. One common limitation involves the relative inability of most physical therapy machines to apply a wide variety of different loads for use by different user's having differing physical therapy or exercising needs. The need for flexibility in loading is also indicated in some exercise machines for increasing strength and durability, wherein it is desirable to provide a machine which allows for more resistance to be required as the user develops strength and is more easily able to overcome the initial resistance setting of the machine. In a rehabilitative setting, it is desirable to provide a machine which is able to decrease the resistance in areas where damage to tissue may occur through overuse, or to increase resistance in areas where muscles are used which need to be developed. Likewise, in a developmental setting, it is desirable to be able to provide an exercise machine having higher resistance in those areas where muscles are used which are desired to be developed. Most prior exercise machines have had difficulty in adapting to these needs and other desires imposed by physical therapists and users. Although common exercise machines have been able to achieve a variety of loads, these machines do not provide meaningful monitoring capabilities. These machines also provide loading which may be disadvantageous for many rehabilitative exercises, and thus cannot be used in this capacity.

Another problem experienced with prior art machines is the difficulty in achieving varying load rate changes during a stroke or other exercise cycle. Although we typically think in terms that a physical movement involves a certain force, it is more typical that forces vary significantly, due either to the type of machine being used or the particular position and anatomy involved. The human anatomy is such that depending upon the particular position of a body part, the load which can be reasonably worked by the muscle groups involved may vary considerably. For example, the leg is capable of producing very large forces when the leg is nearly extended. This should be contrasted to a position wherein the knee is fully bent, wherein relatively less force can be developed by the leg. The rate at which loading changes is different for different muscle groups and varies between individuals. Various exercises may not be therapeutically suitable due to a derogatory effect caused at one extreme of motion, position or loading. Most prior exercise and physical monitoring systems have had little success in providing a wide range of loads while also providing variable loading rates to be achieved.

Prior designs have used several methods to try to achieve different objectives in loading and loading rates. For example, U.S. Pat. No. 5,346,452 to Ku describes an exercise machine having pneumatic cylinders which are coupled to a servomotor which controls a relief valve controlling the amount of air which the pneumatic cylinder may exhaust in a given time period By this means, the rate of exhaust and therefore the resistance imparted to the user may be varied by the servo. U.S. Pat. No. 4,235,437 to Ruis et al. describes an exercise machine having two hydraulic cylinders in a plane which allow for a variety of movements in the X-Y direction. By computer control of the hydraulic pressure within the cylinders, the machine can constrain the user interface to a predetermined path in the plane. The speed at which the user interface moves through the prescribed path may also be controlled by controlling the pressure in the hydraulic cylinders. The apparatus requires that a predetermined path and velocity be programmed into the computer prior to using the apparatus. This requirement greatly impedes use of the machine due to the complex setup requirements.

U.S. Pat. No. 5,312,315 to Mortensen et al. describes an exercise machine having a pneumatic cylinder which may be charged with an initial variable pneumatic gas pressure. In this way, the resistive force which must be overcome by the user may be elevated or lowered, thus elevating or lowering the resistive pressure over the full range of the stroke of the user interface. For example, doubling the initial pressure would also double the maximum force, This can result in an unacceptable force level, Such an approach does not provide flexibility to independently vary loading rates and the magnitude of the loading.

Another significant problem is the need to provide physical monitoring machines which provide accurate and reliable information over the full range of motion developed by the user. Improvements are needed with regard to understanding more completely, the actual forces, torques, velocities and accelerations developed by a user. Such information has not been sufficiently available for either therapy, training or physical diagnostic purposes.

Many prior exercise and physical therapy machines have also not adequately performed to users' expectations because their construction and dynamic response capabilities may have a very noticeable effect on the users' performance. For example, machines which utilize large weights or other large masses suffer from inertial effects which prevent effective training at high velocities while also providing development of large forces. Training for running sprints and many other high speed maneuvers have been particularly difficult given the technology which has existed to date. This difficulty coupled with poor diagnostic techniques have hampered athletes and physically impaired individuals who need an exercise apparatus with a high degree of mechanical compliance with the ability to vary forces. In many situations these individuals also need accurate information indicating the muscular performance which they are able to develop.

The prior art exercise machines either do not allow the resistive force to be varied, allow for the resistive force to be varied only in one dimension, e.g., such as elevating the resistive force over the entire range, or require complex microcomputer control systems to achieve the desired variation in movement of path and rate of movement of the user interface. It is therefore desirable to have an exercise/rehabilitative machine which can provide a variable resistive force throughout the extensive range of the user. It is also desirable to achieve this objective in a simple manner to reduce cost and complexity of the apparatus.

It is further desirable to provide an exercise apparatus with instrumentation and programmable control which allows the user's performance to be calculated and immediately displayed to the user or to a therapist, thereby allowing immediate adjustments to be made and consequently the user's performance to be enhanced.

Thus there is a strong need in the art for an exercise and physical performance monitoring system which can provide a high degree of flexibility and mechanical compliance to allow exercising at a wide variety of loads, loading rates, and velocities. There is also need for such a machine which can be easily adjusted. There is further a need for such a machine which can be used to collect and display data of value in assessing physical performance, physical performance limitations, injuries, and to indicate muscular strength and more general physical conditioning.

BRIEF DESCRIPTION OF THE DRAWINGS

Preferred embodiments of the invention are described below with reference to the accompanying drawings, which are briefly described below.

FIG. 5 is a longitudinal sectional view of a pneumatic ram used in the apparatus of FIG. 2.

FIG. 12 is a side elevational view of a second embodiment apparatus according to the present invention. This embodiment is specially constructed for upper human body development.

FIG. 13 is a perspective view showing a third embodiment apparatus according to the invention. This embodiment is specially constructed for upper body development, in particular pectoral muscle development and performance assessment.

DETAILED DESCRIPTION OF THE PREFERRED EMBODIMENTS

Figure 1:
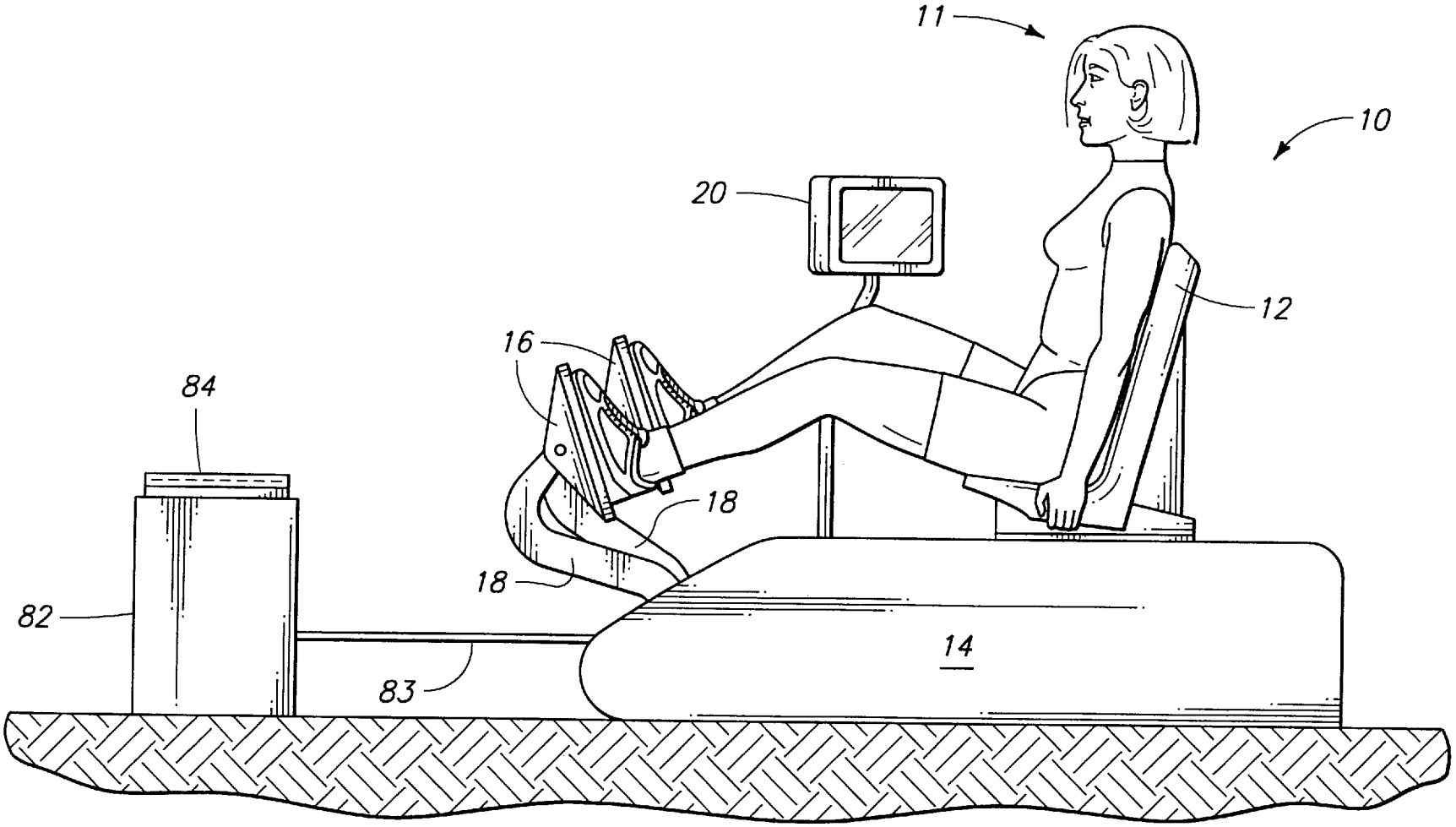
FIG. 1 is a side elevational view of a preferred embodiment combined exerciser and performance monitoring system according to the invention.

This disclosure of the invention is submitted in furtherance of the constitutional purposes of the U.S. Patent Laws "to promote the progress of science and useful arts" (Article 1, Section 8).

TABLE 1

Listing of Subsections of Detailed Description and Pertinent Items with Reference Numerals and Page Numbers

| | |
|---|---|
| First Embodiment - System Generally | 11 |
| exercise and performance monitoring system 10 | 11 |
| seat 12 | 11 |
| user 11 | 11 |
| housing 14 | 11 |
| foot pedals 16 | 11 |
| pedal cranls 18 | 11 |
| video monitor 20 | 11 |
| Frame | 11 |
| frame 26 | 11 |
| frame base members 27 | 11 |
| main frame rails 22 | 12 |
| upright support members 34 | 12 |
| fore end oblique support member 35 | 12 |
| Seat | 12 |
| seat 12 | 12 |
| slidable seat mount 23 | 12 |
| User Interface - Pedal, Crank and Force Transducer Mechanisms | 13 |
| pedals 16 | 13 |
| pedal arms or cranks 18 | 13 |
| pedal crank pivot brackets 30 | 13 |
| pedal crank pivots 28 | 13 |
| pedal pivots 32 | 14 |
| pedal extension brackets 31 | 14 |
| pivot shaft 33 | 14 |
| pedal bearing 91 | 14 |
| bearing housing 92 | 14 |
| force transducer 94 | 14 |
| transducer spokes 95 | 15 |
| strain gauges 97 | 15 |
| pedal crank rotational position encoder 88 | 15 |
| pedal rotational position encoder 90 | 16 |
| Adjustable Load Resisters | 16 |
| force resister 38 | 17 |
| left cylinder 39 | 17 |
| right cylinder 40 | 17 |
| mounting braket 46 | 18 |
| cylinder housing 42 | 18 |
| piston assembly 45 | 18 |
| piston shaft 44 | 18 |
| piston head 48 | 18 |
| Adjustable Load Fluid Supply Subsystem | 19 |
| fluid supply subsystem 123 | 19 |
| air compressor 74 | 19 |
| pneumatic accumulator 152 | 20 |
| pressure sensor 154 | 20 |
| fluid supply relay or relays 156 | 20 |
| check valves 148 and 150 | 20 |

TABLE 1-continued

| Listing of Subsections of Detailed Description and Pertinent Items with Reference Numerals and Page Numbers | |
|---|---|
| dump valves 144 and 146 | 21 |
| dump valve relay or relays 142 | 21 |
| Compressin Ratio Load Rate Adjuster | 21 |
| load rate adjustment positioner 66 | 21 |
| anchoring pin 67 | 22 |
| electric motor 71 | 22 |
| gear box 72 | 22 |
| drive ram 68 | 22 |
| ram housing 69 | 22 |
| jack crossbar 70 | 22 |
| cylinder mounting bracket 46 | 22 |
| pneumatic cylinders 201–204 | 23 |
| Load Connection Linkage | 26 |
| load connection linkage 52 | 26 |
| guide roller 60 | 26 |
| guide roller bracket 61 | 26 |
| bearing mounted spindle 62 | 26 |
| Modifier Linkage Load Rate Adjuster | 26 |
| load modifier 55 | 26 |
| first link 57 | 27 |
| second link 58 | 27 |
| link hinge 63 | 27 |
| third link 64 | 27 |
| three-way link assembly 78 | 27 |
| crank linkage connector 54 | 27 |
| pin 56 | 27 |
| piston/link coupler 65 | 27 |
| mounting bracket 80 | 29 |
| Combined Loading and Load Rate Adjustment | 31 |
| Control System | 33 |
| control system 83 | 33 |
| central controller 82 | 33 |
| keyboard or other input device 84 | 33 |
| display 20 | 33 |
| pressure sensor 154 | 33 |
| force transducer 94 | 34 |
| crank position encoder 88 | 34 |
| pedal position encoder 90 | 34 |
| seat position encoder 25 | 34 |
| Diagnostic & Analytical Modeling | 34 |
| Second Embodiment Exceriser System | 39 |
| exceriser apparatus 100 | 39 |
| frame 112 | 39 |
| handle 102 | 39 |
| pull cable 104 | 39 |
| positon 106 | 39 |
| pneumatic cylinder 120 | 39 |
| guide rollers 108, 110 and 111 | 39 |
| supports 116, 114, and 118 | 39 |
| cylinder housing 130 | 39 |
| jack ram 126 | 39 |
| bracket 128 | 39 |
| slidable mounting 122 | 39 |
| pneumatic fluid pump 132 | 39 |
| pneumatic line 134 | 40 |
| three-point link 138 | 40 |
| modifier link 136 | 40 |
| force link mounting bracket 140 | 40 |
| Third Embodiment Exceriser | 41 |
| exceriser 162 | 41 |
| bench 160 | 41 |
| handles 164 | 41 |
| crank arms 166 | 41 |
| crank pivot 168 | 41 |
| lever extensions 170 | 41 |
| cable 172 | 41 |
| roller guides 174 and 176 | 41 |
| piston 178 | 41 |
| cylinder 180 | 41 |
| jack 182 | 41 |
| three point link system 186 | 42 |
| Operation | 42 |
| Methods | 48 |
| *** (End of Table 1) *** | |

FIRST EMBODIMENT-SYSTEM GENERALLY

Figure 2:
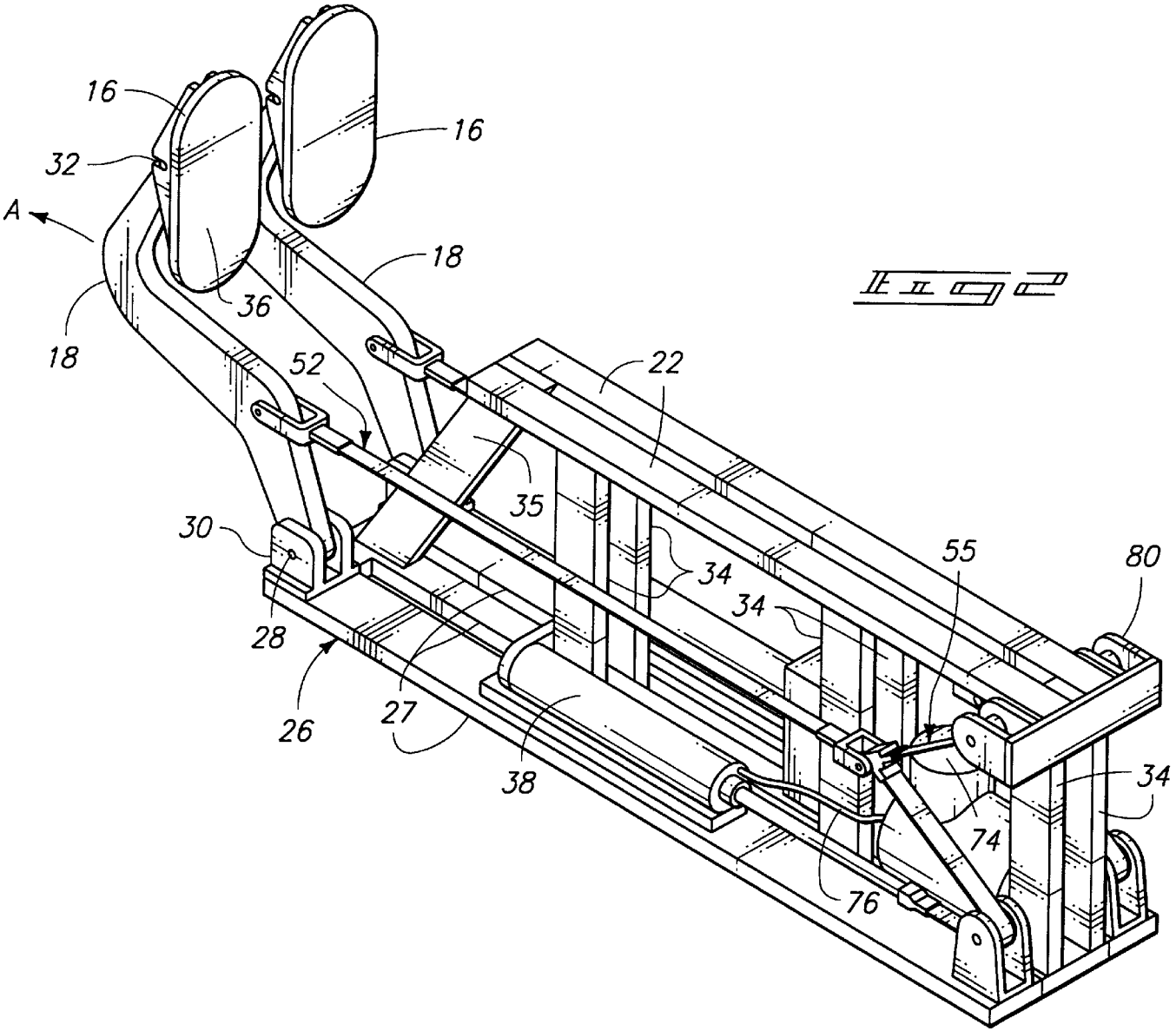
FIG. 2 is a perspective view showing portions of the system of FIG. 1. Other parts of the system shown in FIG. 1 have been removed to better show the portions illustrated in FIG. 2.

FIG. 1 shows a lower extremity exercise and performance monitoring system 10 according to the invention. System 10 includes a seat 12 for supporting or holding a user 11 of the apparatus. The seat is adjustably mounted, preferably by slidably mounting the seat on the apparatus frame, such as at frame rails 22 (FIG. 2). The apparatus also is preferably covered with a housing 14 to enclose most of the mechanical parts and provide improved appearance.

Exerciser 10 also includes a user interface which is engaged by the user to apply force and development movement. The user interface can vary dependent upon the specific construction of the machine and the muscles being exercised and monitored. When using the lower extremity embodiment 10, the user's feet rest on foot pedals 16 which form the user engagement or interface. Foot pedals 16 are connected to the rest of the apparatus by pedal cranks 18.

Exerciser 10 also preferably includes a video monitor 20 which is included with the apparatus to allow the user, therapist or other technician to monitor the performance of the user and the apparatus.

Frame

FIG. 2 shows that exerciser 10 includes a frame 26 which forms the stationary main structural assembly of the exerciser. Frame 26 is made up of frame base members 27 which are connected to the main frame rails 22 by upright support members 34 and a fore end oblique support member 35. The frame base members, main rails, and upright support members are preferably made of a strong, lightweight materials such as extruded aluminum channel, or other suitable materials. Other frame configurations are alternatively possible.

Seat

FIG. 2 shows the apparatus of FIG. 1 with the housing 14 removed. The seat 12 (FIG. 1) forms a user support feature which is preferably mounted on main rails 22. The seat is mounted so that it may be slidably positioned with respect to the foot pedals 16. The seat is mounted to the main rails by a slidable seat mount 23 which will move fore (i.e., towards the pedals), or aft (i.e., away from the pedals). The seat mount preferably includes a seat lock (not specifically shown) which can be locked or released to allow adjustment of the seat position relative to the frame. This allows different sized users to more conveniently use the exerciser. The slidable seat mount and seat lock can be according to a variety of construction known in the art and will not be described further herein.

In a preferred form of the invention the seat is adapted to have a seat position encoder 25 which automatically provides information to the control system as to the seat position relative to the frame and user interface.

User Interface-Pedal, Crank and Force Transducer Mechanisms

Exerciser 10 also includes two pedals 16 which are mounted upon pedal arms or cranks 18. Pedal cranks 18 are movably connected to the frame. This is advantageously accomplished using pedal crank pivot brackets 30 and pedal crank pivots 28. Pedal crank pivots 28 preferably include ball, roller or other low friction bearings having good structural positioning stability to minimize friction and extraneous movement in the exerciser user interface. As shown, the pedal crank pivot brackets 30 are rigidly attached to frame base members 27. Alternatively, it may be desirable to allow the pedal crank pivot brackets or other pivot mounts to be movably mounted to frame base members 27 in order to accommodate a wider range of user interface geometries. In this event, it may be desirable to allow linkage 52 between the pedal crank and the resistant element 38 to be adjustable in length or variations may be accommodated by movement of the adjustable load mount 66 described below. Other aspects of linkage 52 are described more fully below.

Pedal cranks 18 and pedals 16 are preferably made of strong lightweight materials to minimize unintentionally imposed inertia and resistance forces not intentionally imposed by the resistance element 38. Pedal cranks 18 and pedals 16 may be made, for example, of cast aluminum, cast magnesium, carbon fiber, or other strong lightweight material. Pedals 16 will preferably have a textured surface 36 which will prevent the user's foot from slipping off of the pedal during use of the apparatus. The textured surface may be formed in the material out of which the pedal itself is made (for example, channels and grooves may be machined into a metal pedal), or textured surface 36 may be an applied-on surface such as nonskid surfaces commonly used on stair treads and the like.

The angular displacement of the pedal cranks 18 is preferably limited by suitable mechanical stops (not shown) at fully retracted and fully extended positions. The manner of effecting the mechanical stopping action can be done in a number of different constructions. The stops limit the travel of the crank to a desired range. Alternatively, the exerciser can be fitted with one or more adjustable stops which limit the travel of the movable user interface as is desirable for the particular machine and range of travel desired. Such adjustable stops can be subject to programmable control.

Figure 11:
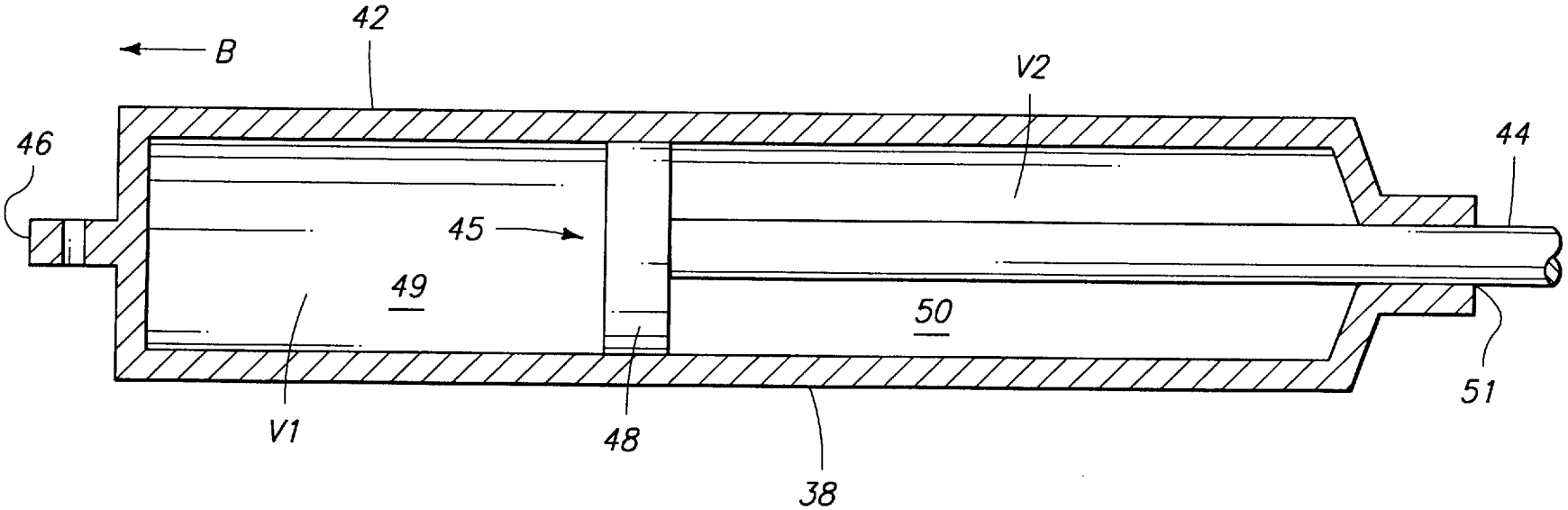
FIG. 11 is an enlarged detail view of a preferred force transducer used at the pivot connection between the pedal and pedal crank of the exerciser of FIG. 1.

Pedals 16 are pivotally mounted to pedal cranks 18 at pedal pivots 32. Pedal pivots 32 are shown in enlarged detail in FIG. 11. Pedal 16 includes one or more pedal extension brackets 31 which mount a pivot shaft 33. Shaft 33 extends through a pedal bearing 91 which may be a needle roller bearing or other suitable bearing. Bearing 91 is supported at the outer race within a bearing housing 92. Bearing housing 92 also forms part of a force transducer 94.

The apparatus of the present invention is further configured with a two orthogonal axis, real time force transducer assembly 94. The force transducer is mounted upon the user interface to detect the various components of force applied to the user interface by the user. In the embodiment 10 the pedal end of each crank is fitted with the transducer to allow sensing of the force applied by the user's foot to the machine. Pedal 16 is preferably mounted to pedal crank 18 by a pivotable bearing 91 so that freedom of action is provided and the forces are resolved at this connection without added torque components which would additionally complicate the sensing and determination of applied forces and torques, Bearing mounting block 92 is fitted with four orthogonal transducer spokes 95. Each spoke 95 mounts a set of opposing strain gauges 97. Each strain gauge provides one or more electrical signals indicating the degree of strain and associated force experienced by the transducer spokes. The applied load is resolved into two orthogonal forces which are used to calculate the instantaneous force vector comprised of direction and magnitude applied to the pedal by the user. The transducer 94 moves with the crank and in combination with the positional encoders described below. This construction allows the direction of the applied force to be accurately determined.

Figure 10:
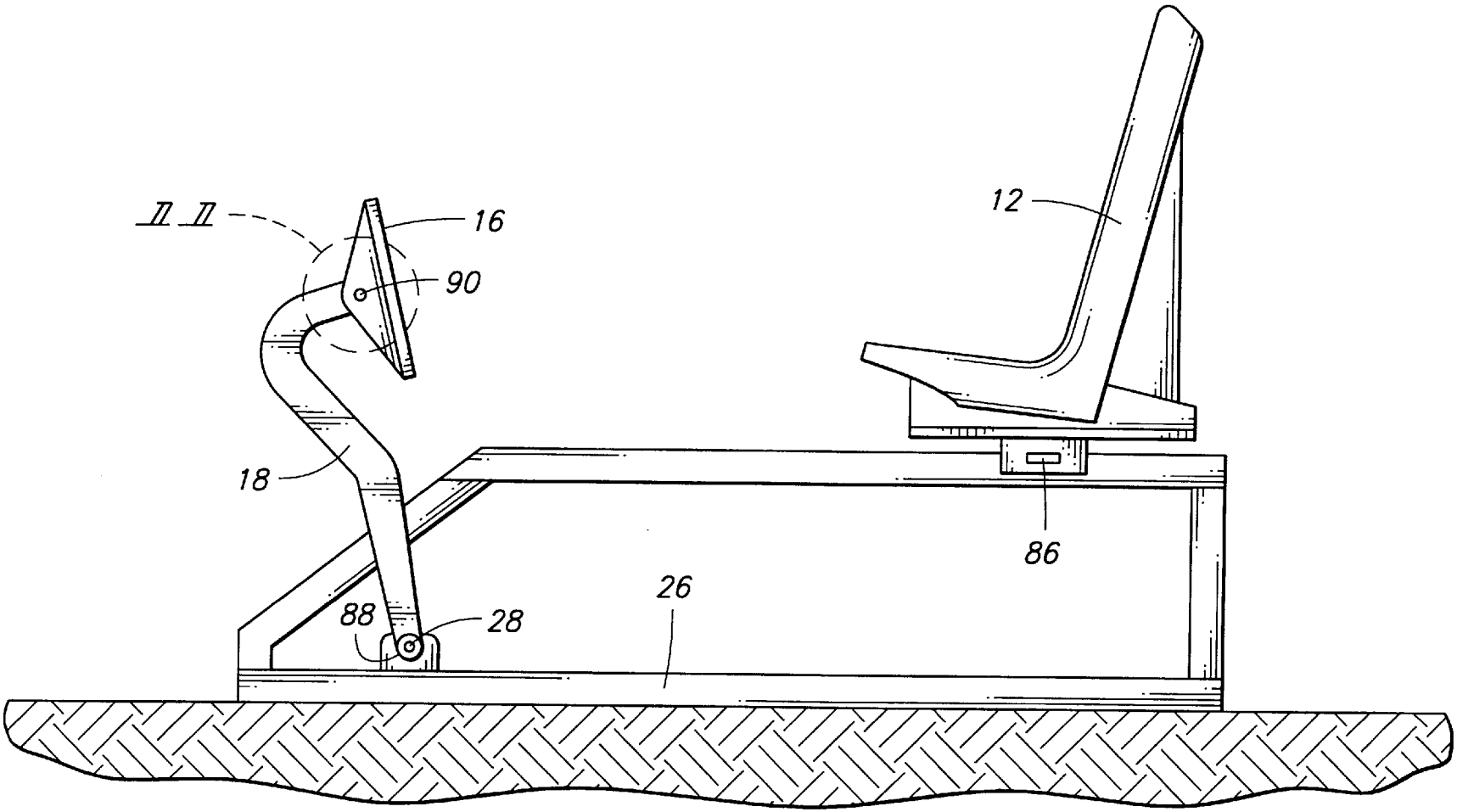
FIG. 10 is a side elevational view of portions of the apparatus of FIG. 1 shown in isolation to better show the instrumentation for position recording of the pedals and seat.
Figure 11:
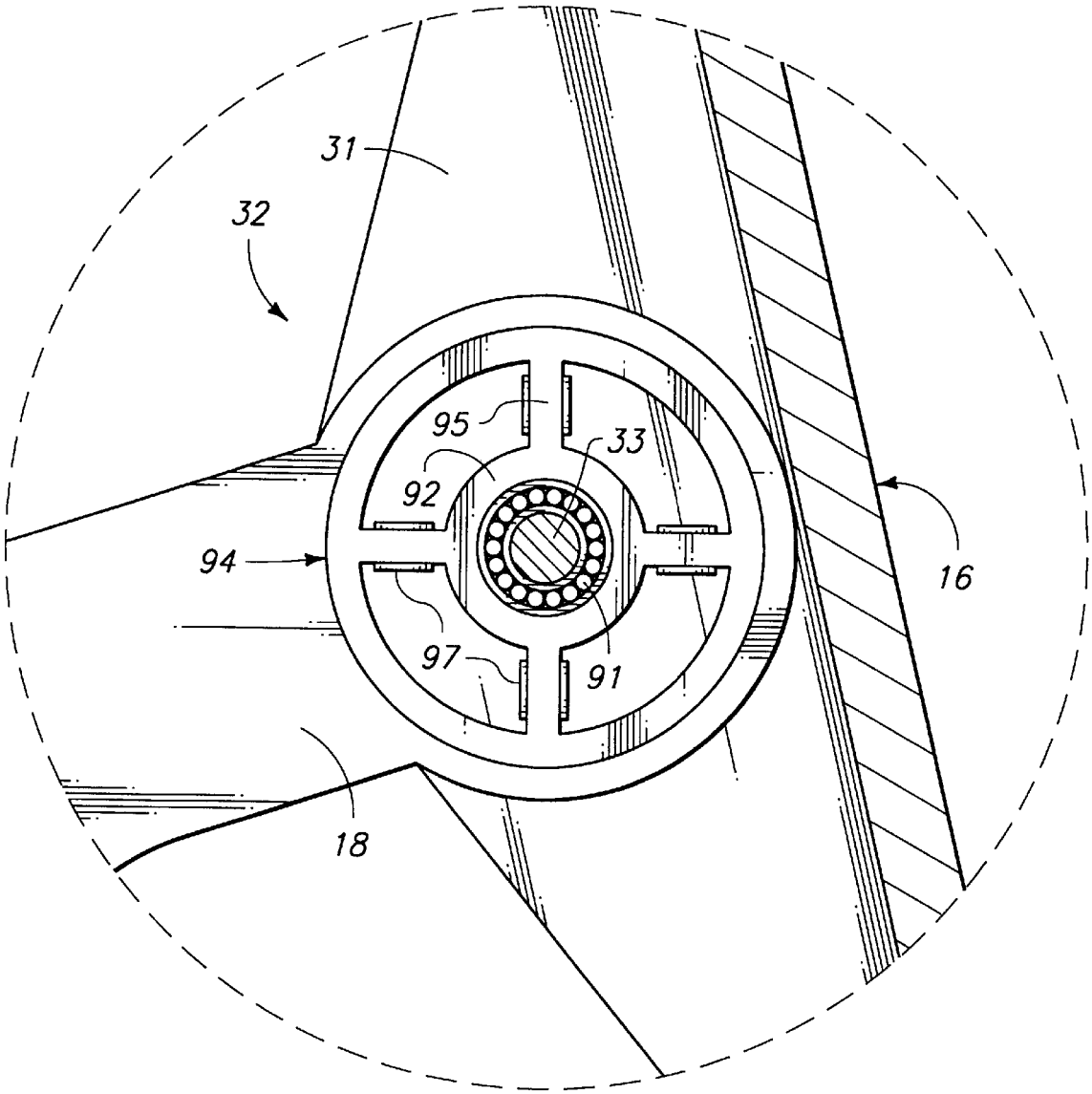
Figure 11:
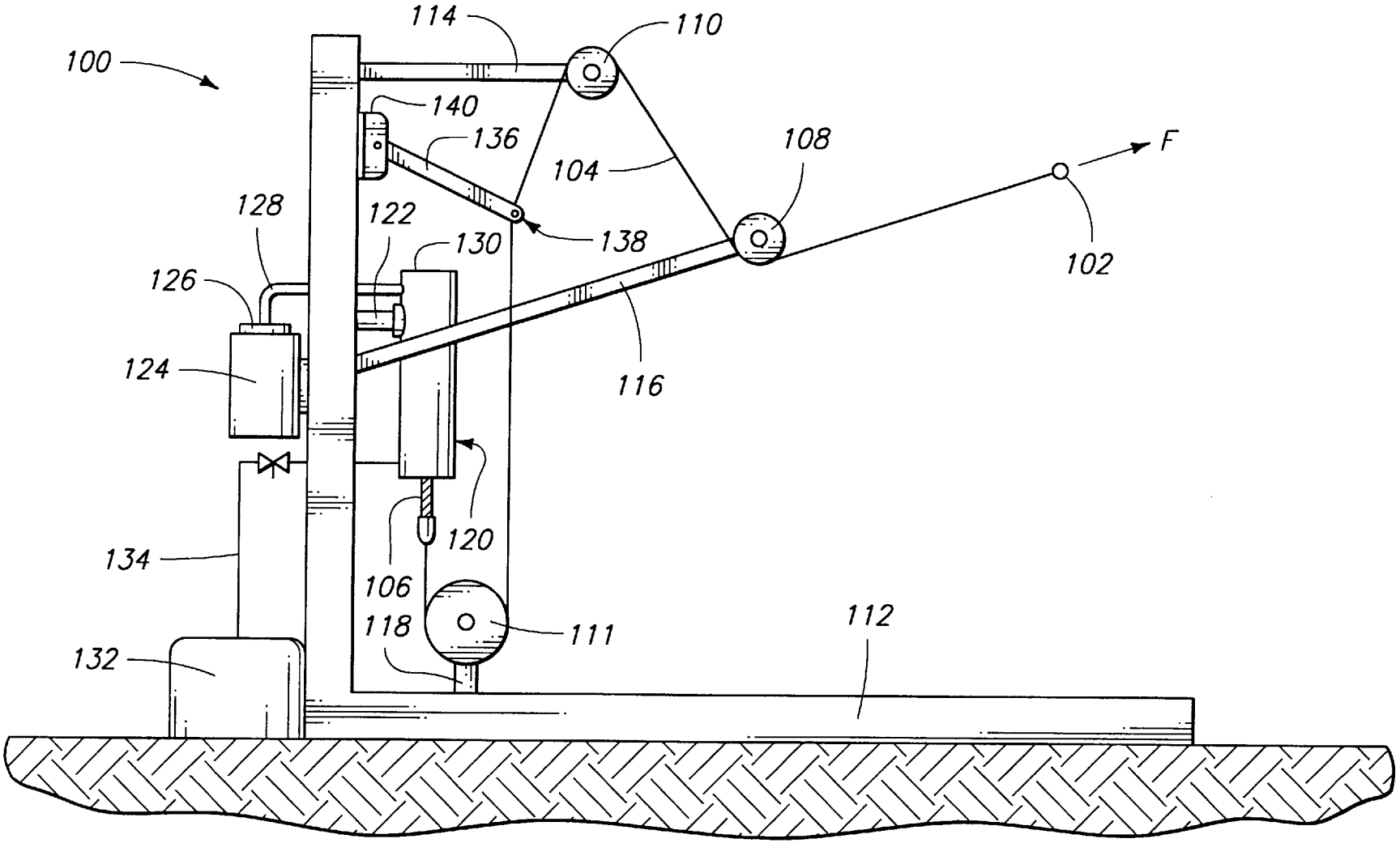
Figure 11:
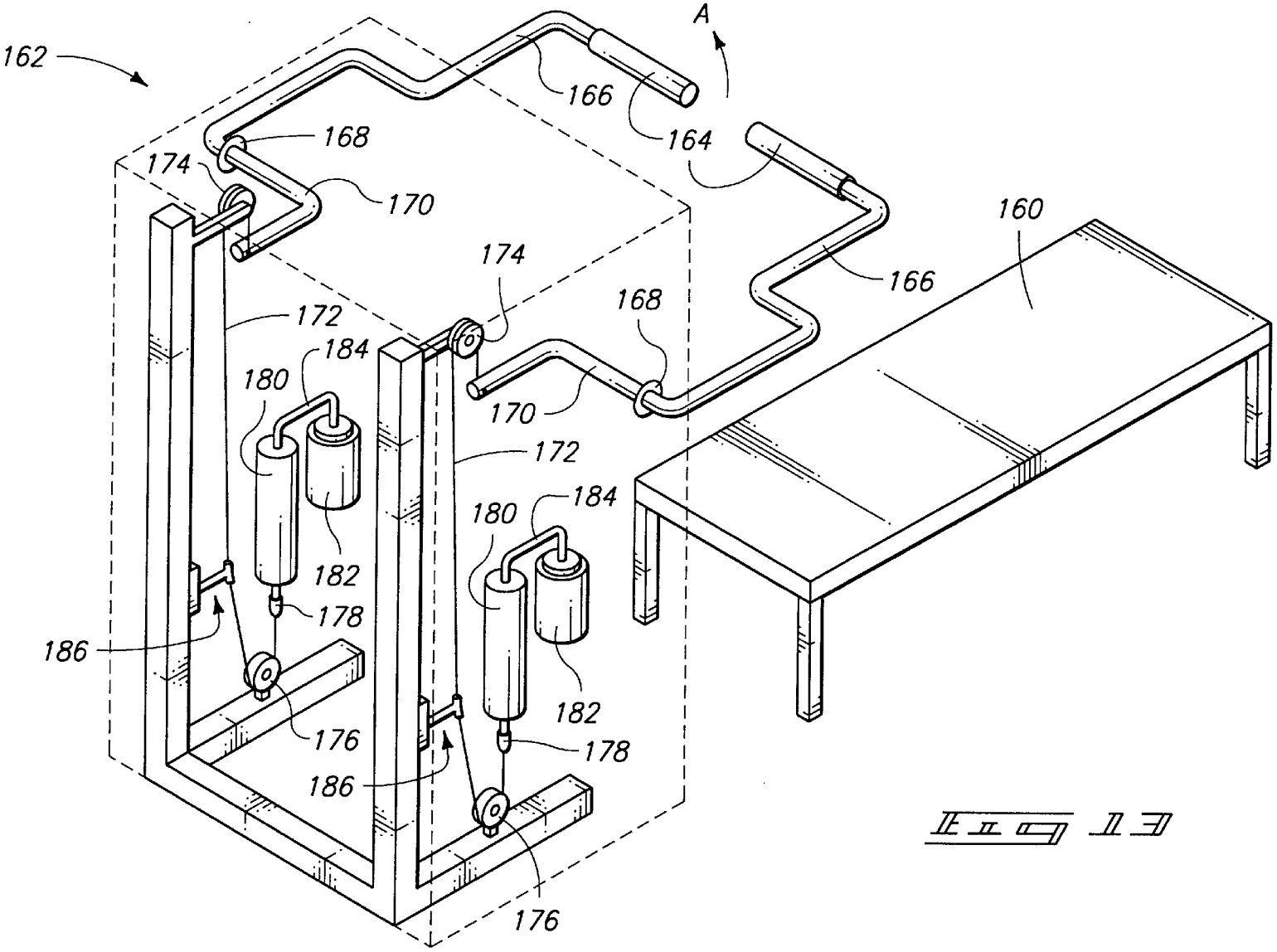

FIG. 10 indicates that pedal crank 18 is configured with pedal crank rotational position encoder 88. Crank encoder 88 is calibrated to a known angular position when the pedal crank is in its at-rest position as described above. As pedal crank 18 moves forward and away from seat 12, crank encoder 88 will determine the angular position from the at-rest position and transmit this information to microprocessor 82. This provides useful information as an additional part of the force/position model described below.

In similar fashion, pedal 16 is configured with pedal rotational position encoder 90 which is calibrated to a known angular position when pedal 16 is in a predetermined position to one extreme of its rotational capabilities. For example, pedal encoder 90 may be calibrated with pedal 16 at its extreme rotation in a clockwise position. As pedal 16 moves in a counter-clockwise position, pedal encoder 90 will determine the angular offset from the calibrated initial position and transmit this information to microprocessor 82 as an additional part of the force/position model.

Adjustable Load Resisters

The exerciser 10 also develops a load which is experienced by the user. The load is adjustable in magnitude and rate of loading to provide improved conditioning, performance assessment, and therapeutic capabilities. In the most preferred forms of the invention, the load is initially a passive load which does not induce force unless movement is undertaken by the user to move the user interface from an initial or rest position. Once the user interface is moved, then active force must be sustained to maintain the user interface in the displaced condition. Additionally, the load is most preferably of a type which increases with increasing user interface displacement. Further, the load is preferably of a type which increases additionally if the velocity of the user interface is increased to higher velocities. Thus it mimics real world conditions for many or most activities associated with physical exertion and athletic training. Although this mode of resistance loading is preferred it should also be appreciated that alternative loading schemes and alternative loading devices can be utilized.

A user using exerciser 10 will sit in the seat 12 of FIG. 1 and place his or her feet on pedals 16. In a rest position, the pedals are closer to the user than they are in an activated or extension position. As the user extends his or her leg, the foot pedal and crank will move in the position indicated by the arrow A in FIG. 2. Forward motion of the pedal will be resisted by a loading device such as force resister 38. In the preferred embodiment shown in plan view in FIG. 3, the exercise apparatus comprises two pneumatic cylinders, a left cylinder 39 and a right cylinder 40. The force resister may also be referred to herein as a resistance element since it resists forward movement of the pedal. The force resister is preferably a compressible fluid resister, and is more preferably a pneumatic ram, often called a pneumatic cylinder. Most preferably, the force resister is a pneumatic cylinder having a suitable compressible working fluid, such as a gas, for example air, which is worked in response to forced displacement of the loading device. Other compressible gases such as nitrogen may be used, but the relative availability of air makes it a preferable compressible gas. Still further it may be possible to use other compressible fluids, such as foams, compressible liquids or combinations of liquids and gases.

Figure 4:
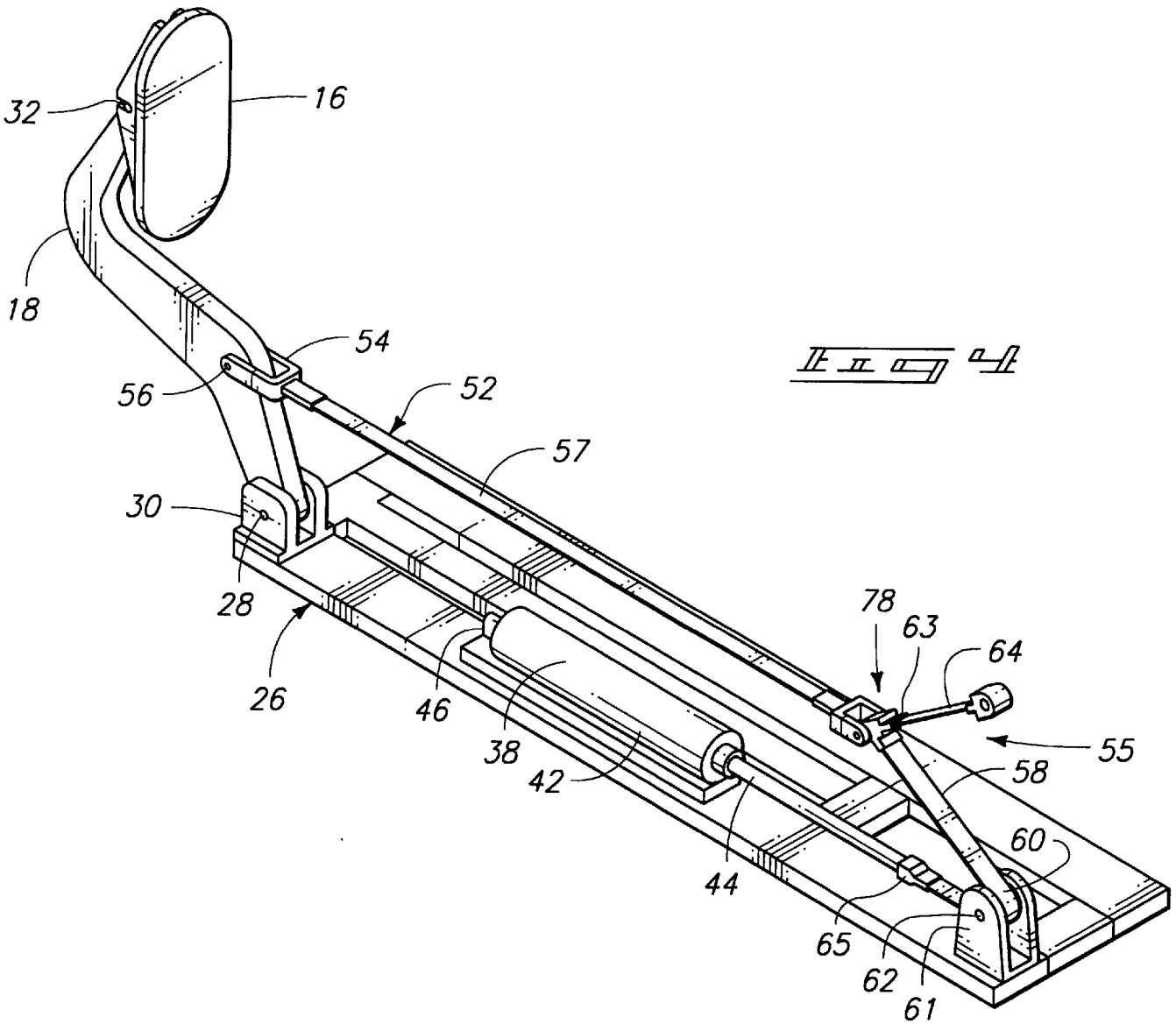
FIG. 4 is a perspective view showing a linkage, three-point link, and pedal as used in the apparatus of FIG. 2.

FIG. 4 is a simplified illustration containing a single pneumatic cylinder 38 and its configuration with respect to pedal crank 18 and frame 26. In one form of the invention (not shown), the pneumatic (air or other compressible fluid) cylinder may be rigidly attached to the frame such as by a cylinder mounting bracket which is not movable with respect to the frame. In the preferred embodiment shown, there is a mounting bracket 46 which is movably mounted with respect to frame 26 as described further below.

The preferred pneumatic cylinder loading device comprises a cylinder housing 42 and a piston assembly 45 (FIG. 5) which are configured in the normal configuration of a pneumatic cylinder. Extending from the piston and through an opening in one end of the pneumatic cylinder is the piston shaft 44. FIG. 5 shows a simplified sectional view of a pneumatic cylinder 38. It is seen that the piston shaft 44 is connected to the piston head 48 which is disposed within the cylinder housing 42.

The piston head separates the cylinder housing 42 into two voids or chambers, a first volume V1 (49) and a second volume V2 (50). It can be seen that by movement of the piston head 48 within the housing 42 the two volumes may be varied with respect to one another and the volumes may therefore be described as variable volumes or variable volume chambers. Seals or piston rings (not shown) which fit between the inner wall of housing 42 and the outer diameter of the piston head 48 will prevent fluid within V1 from moving into V2 and vice versa. Additionally, seals (not shown) within opening 51 will prevent fluid within the pneumatic cylinder from escaping through the opening. V1 and V2 may be sealed with respect to the external atmosphere so that compressible fluid is trapped within each variable volume chamber. Alternately and more preferably, one or more of the variable volume working spaces or chambers may be controllably pressurized, vented to the atmosphere, or provided with a subatmospheric pressure. In the preferred construction a working fluid need only be used within one of the two volumes. In the preferred embodiment volume V1 is vented to atmosphere while volume V2 is sealed and provided with a desired nominal or baseline operating pressure.

The baseline operating pressure is the pressure which exists when the working chamber is at a specified position, such as the initial or starting retracted position. In exerciser 10 this would be associated with the pedal being retracted toward the user 11.

Adjustable Load Fluid Supply Subsystem

Figure 8:
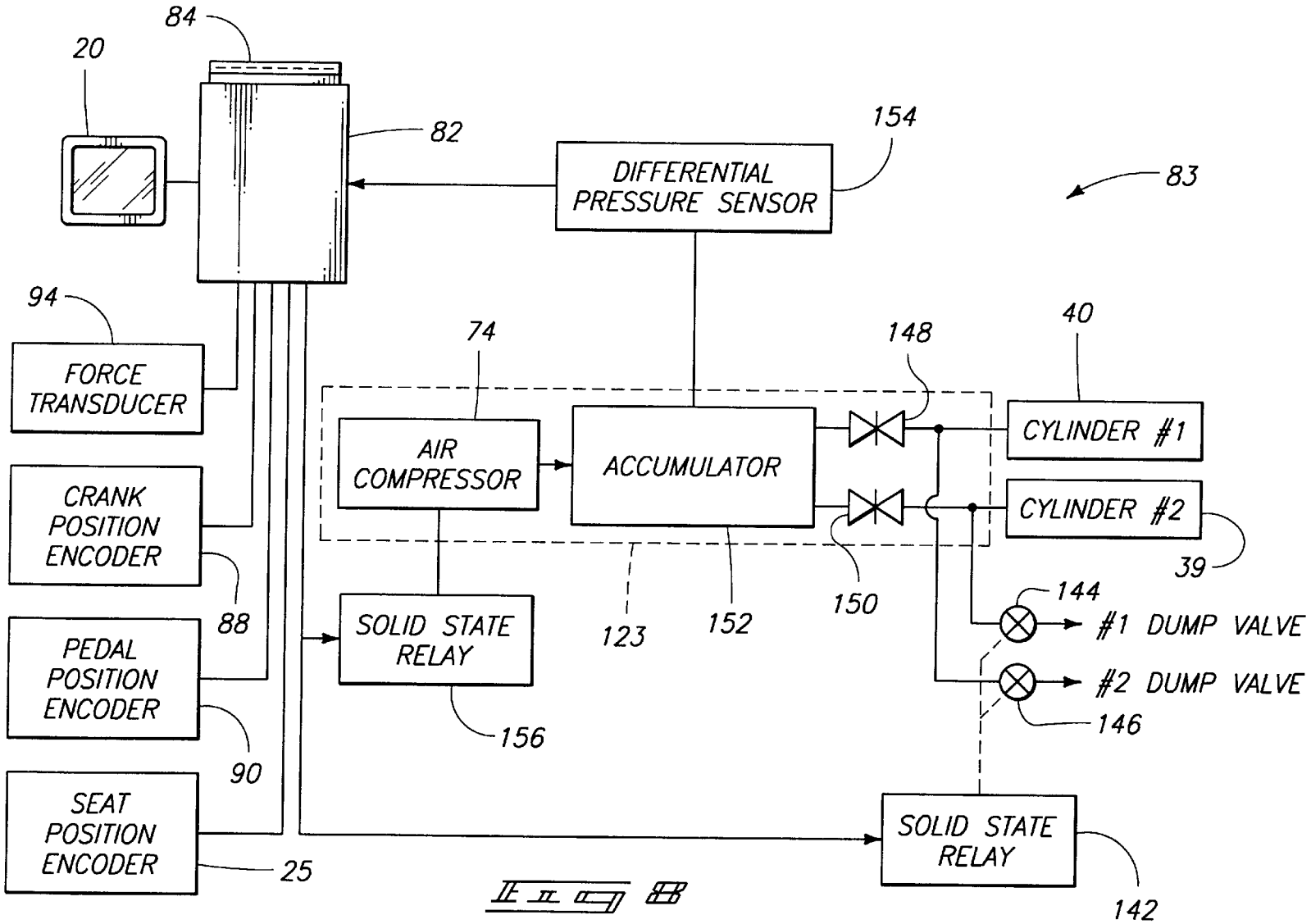
FIG. 8 is a schematic diagram showing the pneumatic, electric and other parts of the system of FIG. 1.

FIG. 8 shows a preferred fluid supply subsystem 123 used in exerciser 10. Fluid supply subsystem 123 includes a compressible fluid prime mover in the form of an air compressor 74 or other suitable supply of working fluid. It should be appreciated that the air compressor 74 can alternatively be replaced with an alternative source of compressible pneumatic fluid such as a nitrogen tank, an air tank, or other apparatus for supplying compressible fluids which are well-known in the art.

The working fluid is preferably readied for use in the pneumatic cylinders 39 and 40 so as to be provided at a desired baseline operating pressure. The baseline operating pressure used will establish the minimum load and be a primary parameter in determining the load experienced by the user throughout the entire range of travel of the pedals or other user interface.

The fluid supply system 123 also preferably includes a pneumatic accumulator 152 for storing the pressurized fluid. The desired operational pressure can be subatmospheric, atmospheric, or more typically superatmospheric. Such desired operational pressure is communicated to one or more chambers of the fluid working load resisters 39 and 40 in a manner which is preferably regulated to a minimum at the baseline pressure. As shown, the pressure is regulated by sensing the pressure within the accumulator 152 using a pressure sensor 154. When pressure falls outside of a desired range and additional pressure is desired then controller 82 calls for compressor 74 to supply fluid to the accumulator 152. This can be effected using a solid state or other suitable fluid supply relay or relays 156.

The fluid supply system also preferably includes check valves 148 and 150. Check valves 148 and 150 act as one-way valves which allow pressure to pass from the accumulator to the working chambers of the cylinders 39 and 40, thereby maintaining the controlled and adjustable baseline setpoint pressure. The check valves also prevent pressure increases from passing back to the accumulator which would otherwise be caused when the user displaces the pedal or other user interface.

The working fluid supply system can also be defined to include dump valves 144 and 146. Dump valves 144 and 146 are used to release pressure from the working chambers of the cylinders 39 and 40. This is typically done if the baseline pressure is reduced by adjusting the desired setpoint. Other operational regimes may also indicate the use of the dump valves for other purposes. Dump valves 144 and 146 are activated by a solid state or other suitable dump valve relay or relays 142 which are controlled by controller 82.

Compression Ratio Load Rate Adjuster

Figure 6:
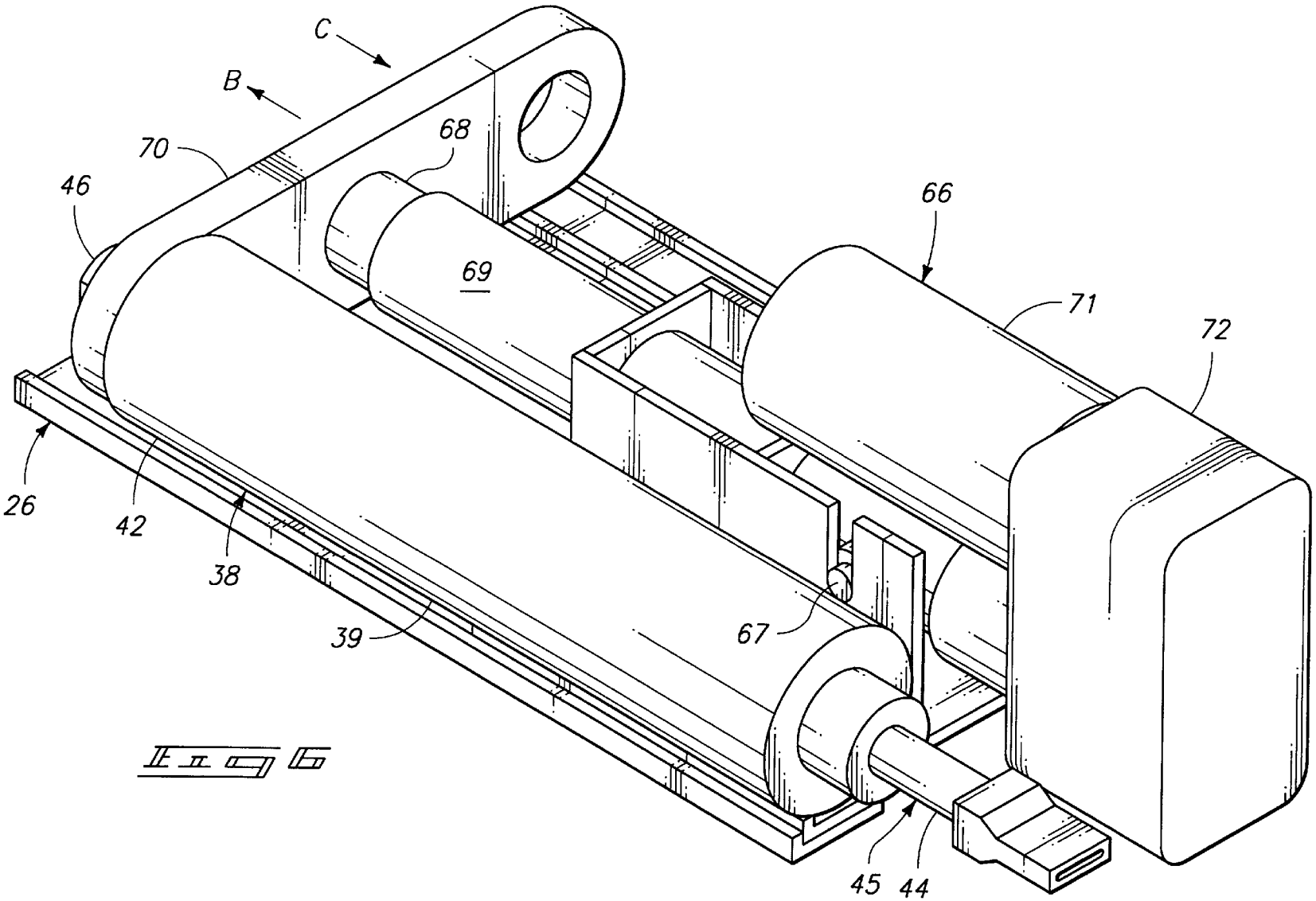
FIG. 6 is a perspective view showing a subassembly forming a part of the apparatus of FIG. 2.

Referring now to FIG. 6, a detail of the preferred embodiment in which the pneumatic cylinder 38 is coupled to a load rate adjustment positioner 66 is shown. In this embodiment, the housings of the cylinders 38 are connected to a movable positioner allowing the cylinder housing 42 to be slidably located relative to the frame 26 and independent of the position of the piston 45. Allowing housing 42 to be positioned independent of the piston head 48 of FIG. 5 allows for the compression ratio of the pneumatic cylinder to be varied, as is more fully described below. In the preferred embodiment in which a positioner is used, the positioner 66 may be a movable mount with associated jack as shown in FIG. 6. The jack is securely anchored to the frame 26 by a anchoring pin 67 or other anchoring means, including bolting, welding, etc. The pin 67 allows for the jack to be easily removed for maintenance and service without requiring extensive effort or damage to the apparatus. The jack may either be a hydraulic jack or a gear jack. In the preferred embodiment, the jack will be gear-driven and will have an electric motor 71 which will drive a geared shaft (not shown) through gear box 72. Jack gear box 72 will reduce the rotations of electric motor 71 so that the geared shaft will revolve relatively slowly with respect to the electric motor speed. The geared shaft will move a drive ram 68 relative to a ram housing 69. In an alternate embodiment in which a hydraulic jack is used, ram 68 will be the end of a hydraulic piston which will be driven by hydraulic cylinder housed by ram housing 69, and gear box 72 will be replaced by a hydraulic pump. Ram 68 is connected to jack crossbar 70 which serves as part of a movable mount for the cylinders 39 and 40. The crossbar 70 is connected to a cylinder mounting bracket 46 by a pin (not shown). As the ram 68 moves in the forward direction, as indicated by the arrow B, the jack crossbar 70 will pull the cylinder housing 42 in the forward direction. As cylinder housing 42 moves in the forward or "B" direction, the piston 45 will remain biased in the reverse or "C" direction by virtue of the mechanical linkage between the pedal crank 18 and the piston shaft 44. As can be seen by reference to FIG.

5, moving the housing 42 in the direction indicated by the arrow B, while maintaining the position of the piston head 48, will have the effect of increasing volume 49 and reducing volume 50.

Figure 7:
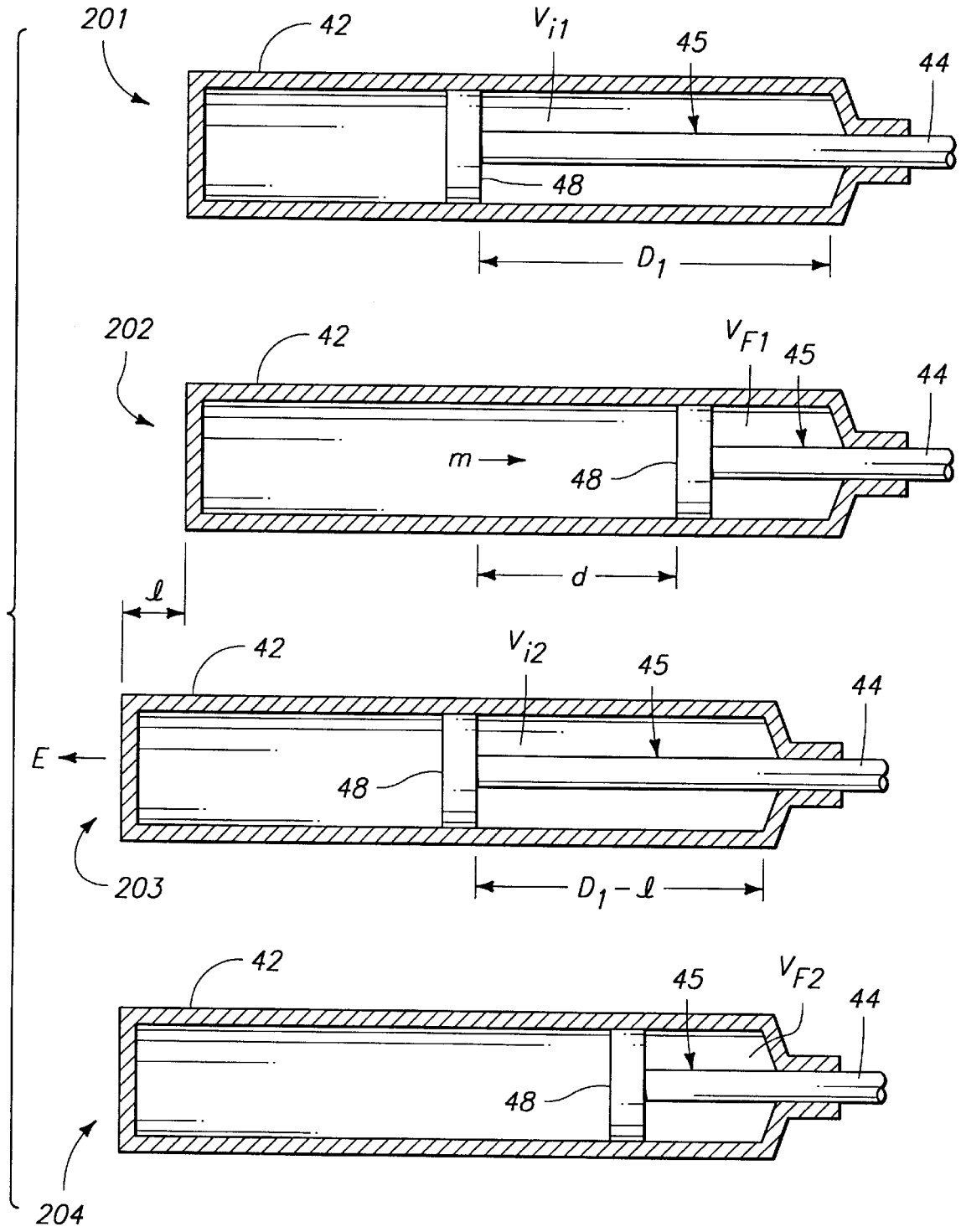
FIG. 7 is a sectional view showing the pneumatic ram of FIG. 5 in four different positions.

As is well known, the initial volume in a cylinder as a ratio of the final volume in a cylinder following the compression stroke of a piston in the cylinder can be expressed in terms of a compression ratio, which is the initial volume divided by the final volume. As indicated above, by moving housing 42 relative to piston head 48, the initial volume 49 or 50 can be changed. Assuming the piston head does not strike the end of the cylinder housing 42 during the compression stroke, the stroke of the piston will be determined by the length of travel of link 57 before being arrested by a mechanical obstruction. Thus, the compression stroke of the piston within the pneumatic cylinder will remain constant regardless of the position of the housing 42. FIG. 7 diagrammatically shows similar pneumatic cylinders 201–204 with housing 42 in two different cylinder positions and piston 45 in two different piston positions within each of the cylinders. In the two top cylinders, 201 and 202, the cylinder housings are shifted to the right with respect to the piston shaft 44. In the two bottom cylinders, 203 and 204, the cylinder housings have been shifted to the left a distance "l". As can be seen with reference to cylinder 201, with the piston 45 in an uncompressed mode, the initial volume in a first case $V_i$; is defined by the distance $D_1$ between the end of the cylinder and the piston head multiplied by the inside diameter of the housing 42, and subtracting out the volume of the piston shaft 44. When the piston undergoes a compressive stroke moving in the direction m as shown by cylinder 202, a final volume $V_{F1}$ is obtained which can be easily calculated. The compression ratio in the first case is then $V_{i1}$ divided by $V_{F1}$. When the jack 66 of FIG. 6 has been activated moving the housing 42 in the direction indicated by the letter E a distance l as shown by cylinder 203, the initial volume $V_{i2}$ now becomes the quantity ($D_{1-}$) times the inside diameter of the housing 42 minus the volume occupied by the piston shaft 44. After the compressive stroke, the final volume is $V_{F2}$, shown by cylinder 204. The compression ratio in the second case is $V_{i2}$ divided by $V_{F2}$. Assuming that the compressive forces exerted on the piston head 48 by the compressed gas in the final volumes $V_{F1}$ and $V_{F2}$ are equal to the force applied by the user to the pedal, the final volumes $V_{F1}$ and $V_{F2}$ should be the same. It can be seen that as housing 42 moves to the left, initial volume $V_{i2}$ is decreased by the amount of l times the inside diameter of housing 42 minus the area occupied by shaft 44. Thus, the final volume $V_F$ will remain the same while the initial volume $V_i$ will be decreased. Therefore, by moving the cylinder housing 42 to the left, the compression ratio will be decreased since $V_{i2}$ will be a smaller number while the final volume $V_F$ will remain the same.

The practical effect of changing the compression ratio is that rate of loading will change for a given displacement of the user interface. More specifically, the resistive force exerted by the pneumatic cylinder on linkage 52, which is important in determining the load experienced by the user at pedal 16, can be estimated using the well-known ideal gas law, $P_1V_1T_1=P_2V_2T_2$. Since the temperature is roughly the same in both cases as the volume decreases due to the compressive stroke, the resistive pressure exerted on the piston head 48 will increase, thereby increasing the force required by the user to overcome the resistive force. If the travel distance of the piston is reduced by moving the cylinder housing 42 to the left as shown by cylinder 203 of FIG. 7, the pressure will increase at a faster rate as the volume decreases at a faster rate. In this manner, a great degree of flexibility in adjusting the load rate experienced by the user of the apparatus may be accomplished.

Additional variability may be obtained by increasing or decreasing the amount of the compressible fluid within the pneumatic cylinder. Referring again to the ideal gas law described above, it can be seen that as $P_1$ is increased, to keep the equation balanced $P_2$ will necessarily need to increase. That is, adding additional compressive fluid to the initial volume $V_i$ of cylinder 201 and 203 of FIG. 7 will have the effect of shifting the force-versus-compression distance curve upward overall. Referring to FIG. 2, additional apparatus for adding compressive fluid to the pneumatic cylinder 38 is shown. An air compressor 74 acts as a supply of pneumatic fluid to the cylinder. The supply source 74 will provide pneumatic fluid through pneumatic fluid supply line 76.

Load Connection Linkage

Referring again to FIG. 4, the pneumatic cylinder 38 is connected to pedal crank 18 by a load connection linkage 52. Linkage 52 may be according to a variety of different constructions and configurations. In some forms of the invention, the linkage may be a single element connected to the pedal crank 18 on one end and the end of piston shaft 44 at the other end. However, in more preferred embodiments according to this invention, linkage 52 is provided with additional features and capabilities. For example, in exerciser 10 the linkage is reversed about guide roller 60 which is connected to frame 26 by guide roller bracket 61. In this manner, a more compact exercise machine may be provided. Guide roller 60 is preferably mounted to guide roller bracket 61 by a bearing mounted spindle 62. Such a mounting arrangement provides for a reduced friction mechanism allowing the force from the pneumatic cylinder 38 to be transmitted through linkage 52 without imposing frictional forces to the linkage.

Modifier Linkage Load Rate Adjuster

In the preferred embodiment, the load connection linkage 52 is preferably constructed so as to include or connect with a load modifier 55. The load modifier includes one or more members which share part of the load which is exerted by the user through the user interface. The load modifier 55 as shown is a passive mechanical link which engages with the load connection linkage and takes a varying amount and percent of the load as the user interface is displaced by the user.

As shown in exerciser 10, the load modifier includes a three-part linkage 78, having a first link 57 connected to a second link 58 at link hinge 63. A third link 64 is joined with the first link 57 and second link 58 at link hinge 63 to form the three-way link assembly 78, the function of which is described more fully below.

The first link 57 is directly connected to pedal crank 18 using a flexible strap or other suitable linkage at crank linkage connector 54. Linkage connector 54 is pivotally connected to the crank by a pin 56 or other suitable connector which is preferably detachable for assembly and maintenance purposes. As with other connections previously described, connector 56 may also be provided with a bearing mounted spindle (not specifically illustrated).

Links 57, 58 and 64 are preferably made of a lightweight, strong, flexible, non-stretchable material such as Kevlar webbing or metal chain, so as to maintain desired spacial relationships without substantial longitudinal elongation variations. When coupled with the preferred embodiment incorporating the guide roller 60, second link 58 is preferably a flexible material capable of repeating numerous cycles about the guide roller without fatiguing.

The second link 58 is connected to the piston shaft 44 by the piston/link coupler 65. While in the preferred embodiment, the first link pin connector 56 is coupled to the pedal crank 18 at a position between pedal 16 and pedal crank pivot bracket 30, it can be seen that one skilled in the art could easily modify the machine by locating the pedal crank pivot point 28 above the first link connector point 56. This has the effect of biasing the foot pedal in a forward position i.e., away from the seat, necessitating the use of a direction reversing roller to bias the pedal in the preferred position toward the user. Such mechanisms for reversing the direction of linkage are well known in the art.

Figure 9:
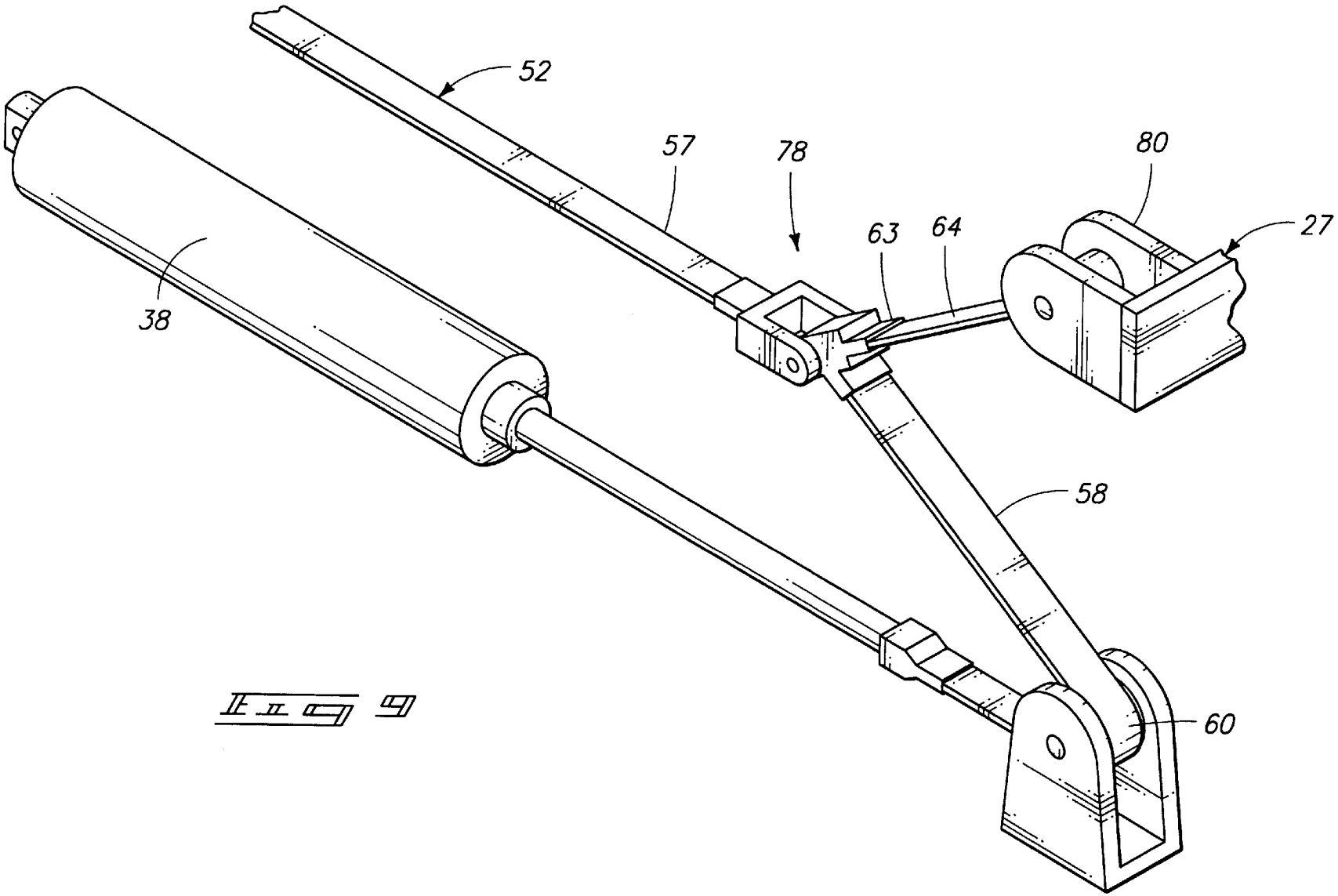
FIG. 9 is a perspective view detailing portions of the apparatus of FIG. 2 relating to a preferred three-point linkage.

Turning now to FIG. 9, the three-point link 78 is shown which comprises the first link 57, the second link 58, and the third link 64. The first, second, and third links are joined by link hinge 63. Third link 64 is pivotally attached to third link mounting bracket 80 which in turn is mounted to frame 27. It is apparent that, excepting frictional forces in guide roller 60, resistive forces required to overcome the compressive resistance of pneumatic cylinder 38 are transmitted directly to pedal crank 18 at pin 56 of FIG. 4. Generally, a force supplied by the user at pedal 16 will need to be only marginally greater than the resistive force imparted on linkage 52 by pneumatic cylinder 38. The three-point link has the effect of adding a third member into which force may be transmitted. In general, third link 64 will serve to transmit part of the force supplied by the user at pedal 16 to frame 27 via mounting bracket 80. In this manner, a greater force will be required by the user at pedal 16 to overcome a lesser force resisted by pneumatic cylinder 38 by virtue of the force imparted to frame 26 by virtue of a rigid, hinged connection between third link 64 and mounting 80 (and frame 26).

The load carried in the first link is shared by the second and third links. The relative amounts and proportions of the load shared by the second and third links is affected by a number of considerations The primary consideration is the construction of these two links and the relative lengths and spacial geometries. An analysis according to the principals of statics indicates that depending on the relative angles of the first, second and third links, the loading will vary on the first and third links. (The loading on second link 58 is determined by the pressures within cylinder 38.) Also noteworthy is the fact that as the third link 64 swings about its pivot point, then the geometry and amounts and proportions of loading also vary. To provide an example, if the third link 63 is swung toward the rear of exerciser 10, then a greater proportion of the load is carried by the third link. This provides a user load force which increases dramatically as the third link pivots clockwise as shown in FIG. 4.

The adjustment in load rate associated with the load modifying third linkage arrangement can be easily adjusted by changing the position or relative orientation of the link hinge 63. This can be done by using the jack 66 described elsewhere herein to vary compression ratio. Alternatively, the relative orientations and positions of the modifying link can be changed by varying the position of mounting bracket 80. This could be done either manually or using a controllable movable mounting assembly (not shown). Alternately, first link 57 and/or second link 58 may be configured so that they are adjustable in length allowing the location of three-point link 78 to be moved with respect to mounting bracket 80, thus changing the angle between first, second, and third links 57, 58, and 64, respectively. Further, third link 64 may be configured so that it is adjustable in length allowing the link hinge 63 to move closer to mounting bracket 80 or further away from mounting bracket 80.

With sufficient adjustability in position of hinge 63, and by adjusting the position of mounting bracket 80 relative to the link hinge 63, is be possible to impart a force in linkage 52 which is directed toward pedal crank 18. This has the effect of reducing the force required by the user on pedal 16 required to overcome the resistive force of cylinder 38. By positioning the location of mounting bracket 80 with respect to link hinge 63 such that the angle formed between third link 64 and first link 57 is an obtuse angle, the opposite effect is obtained. Third link 64 may be adjusted in a variety of manners so as to change the geometry of the three-way connection formed between first link 57, second link 58 and third link 64, with concomitant results as dictated by the laws of statics. Generally, three-point link 78 will remain in balance until a sufficient force is applied by the user to pedal 16 and first link 57 to overcome the forces acting on second link 58 and third link 64, causing the three-point link 78 to move in the forward direction, i.e., toward the pedal crank 18. Generally, as pedal 16 is pushed in a forward direction away from the seat 12 of FIG. 1, the three-point link will move through an accurate path. As a three-point link moves through the arcuate path, the third link 64 will have a varying force imparted to it, thus producing a nonlinear force-to-extension-distance response diagram. Since the rate of the movement of the three-point link 78 will depend on the forces acting on the link at any given time, it may also be seen that the acceleration and/or velocity of the pedal is determined by the forces acting on the three-point link. By inverse static and inverse kinematic calculations, it is possible to determine the geometry required at the three-point link, given the pressure versus compression distance performance characteristics of the pneumatic cylinder, to produce a desired force/velocity/acceleration result at the pedal 16 necessary to overcome the physical restraints imposed on the system by the three-point link 78 and the force resistor 38.

Combined Loading and Load Rate Adjustment

In the most preferred embodiment, the variable compression ratio provided by the movable pneumatic cylinder housing, the compressible fluid pressure and associated force affecting the initial resistive force, and the variable force distance geometry provided by the three-point link are combined into one exercise apparatus to provide an extremely wide range of variability in loading magnitude, loading rate, and associated performance dynamics experienced by the user. In this manner, it is possible to configure the apparatus so that a known force versus pedal extension relationship is established to achieve a predetermined velocity and/or acceleration result, thereby allowing approximate predetermined forces to be imparted to user during use of the apparatus as a function of movement of the user, such as by movement of the user's limbs or other body parts.

For example, it is well known that as a person extends their limb, different muscles are brought into play at different points during the extension. If it were desirable to develop particular muscles, or if particular muscles had been injured and it was desirable to inflict less stress on those muscles during an exercise regimen, then it would be possible to configure the apparatus of the present invention to exert a greater or lesser resistive force on the foot pedal 16 by virtue of the dynamics imparted to the foot pedal by the pneumatic cylinder 38 and the three-point link 78.

In light of the variability of the apparatus and the desire to select a particular configuration in light of a particular user's requirements, it is necessary to be able to measure the forces imparted to the user during use of the machine. It is particularly desirable to provide instrumentation which allows for an instantaneous feedback to the user or a therapist of the forces that are being imparted at any given time so that adjustments may be made to the apparatus to achieve a more desirable result.

Control System

Exerciser 10 also preferably includes a control system 83 which is best shown in FIG. 8. Control system 83 is used to provide automatic control of various operational parameters Control system 83 is further preferably provided with the ability to record data sensed by various sensors and detectors preferably included in the exerciser.

The control system includes a central controller 82 which can advantageously be provided in the form of a multi-use computer. Computer or other controller 82 can be fitted with a suitable keyboard or other input device 84. The user or therapist will enter the desired set points at keyboard 84. Keyboard 84 is integrally or otherwise appropriately connected to computer 82.

The control system also preferably includes a display 20. Display can be used for displaying information concerning control, programming, data acquisition, data processing, or various analytical functions performed by controller 82. Ancillary data processing functions can alternatively be performed in a related computer to speed processing time or provide greater analytical capabilities.

The control system also preferably includes the pressure sensor 154 used to control baseline pressure in accumulator 152.

The control system can further advantageously be constructed to include various system sensor and detectors for providing automatic input of conditions relevant to performance assessment and analysis. As shown, the control system additional includes inputs to controller 82 from the force transducer 94, crank position encoder 88, pedal position encoder 90, and seat position encoder 25.

Diagnostic & Analytical Modeling

The apparatus of the present invention is preferably provided with a man/machine model which allows for the kinematics of the apparatus and the kinetics of the user to be calculated as suggested above. The man/machine model is preferably programmed into a microprocessor shown as controller 82 which communicates with the apparatus by cable 83 (FIG. 1). Data may be input into the microprocessor by use of keyboard 84, which may also be used to query the microprocessor to obtain information. Inputs and information may be displayed on video monitor 20 or may be displayed on a separate monitor connected to microprocessor 82. Although microprocessor 82 is shown as being separate from the apparatus in FIG. 1, it may also be mounted within or on housing 14 of the apparatus. The man/machine model comprises three interacting sections: 1) the force/position model which describes the resistance characteristics of the apparatus including characteristics of variable compression ratio, three-point-link dynamics, and compressible fluid quantity; 2) the subject model which consists of the subject user's anthropometrics; and 3) the inverse dynamics model which calculates the kinematics of the apparatus and the user and the kinetics of the user, based on direct force and position measurements and the subject user model.

A beneficial characteristic of the apparatus of the present invention is that the geometries of a user with respect to pedals 16 of FIG. 2 are constrained, allowing for the system to be easily modeled to determine forces acting on the user. By considering the hip, knee joint, and ankle of the user as being all in the same plane, one may easily construct a force/distance model and, knowing forces acting on certain points within the system, and distances between one point and another within the system, calculate forces at other points within the system. One example of such a model is described in U.S. Pat. No. 5,421,798 to Bond et al. which is hereby incorporated by reference. In the preferred embodiment of the present invention where a user will place his or her feet on pedals 16 and move the pedals in a forward motion, the path traveled by the pedals will be in an arcuate path described by the length of the pedal crank 18 as it pivots about pedal crank pivot point 28 as shown in FIGS. 1 and 4. The user's hip will remain essentially fixed by virtue of the position of seat 12. The distance between seat 12 and pedal pivot point 32 are known or can be easily measured or provided by seat position encoder 25. By use of the pedal rotational position encoder 90, it is possible to measure the displacement of pedal pivot point 32 from its rest position as it moves forward through the arcuate path as a result of force input by the user. By measuring the length of the distance between the user's hip and the user's knee, and the distance between the user's knee and pedal pivot point 32, a two-link model may be constructed of the kinematics of the user's leg as it moves through a path described by the extension of the leg in pushing pedal 16 through the arcuate path defined by pedal crank 18 and pedal crank pivot point 28. The method of developing the two-link kinematic model will be obvious to those skilled in the art.

To perform the calculations, it is necessary to take certain measurements of the user's physiology to construct a subject user model, such as the dimensions described above between the hip, knee and foot of the user.

In order to perform the calculations described above, it is necessary to know the position of seat 12 with respect to pedals 16. Seat 12 is configured to be adjustable with respect to frame 26 to accommodate users of different dimensions. With reference to FIG. 10, seat 12 may be configured with seat position encoder 25 which determines the distance between seat 12, pedal crank pivot 28 and pedal pivot 32. Since the angle of the pedal crank 18 in the at-rest position (i.e., biased toward seat 12) is known, the geometrical model between seat 12, pedal crank pivot 28, and pedal pivot 32 may be easily constructed and distances easily determined so that seat position encoder 25 may be calibrated to a certain end point position, typically when seat 12 is fully retracted at its farthest point from pedal 16. As seat 12 move forward towards pedals 16, seat position encoder 25 will determine the horizontal distance the seat has moved and relay this information to microprocessor 82. This information comprises part of the force/position model described above.

The force/position model is configured such that when seat 12 is moved from a position other than the calibrated end position, the force/position model will recalculate the distances and angles between seat 12, pedal crank pivot 28, and pedal pivot 32.

Since rotational position information from rotational position encoders 88 and 90 is provided to microprocessor 82, and since microprocessor 82 may contain a real time clock, it is possible to calculate the angular velocities and angular accelerations of pedal crank 18 as well as pedal 16. Additionally, by trigonometry and kinematics, it is possible to determine accelerations and velocities of the user's ankle, knee and rotational velocities and angular accelerations about the user's hip, knee, and ankle, as a result of anthropomorphic information entered into the user model as described above. Additional force transducers may be mounted on bearing mounting block 92 as described earlier to measure forces acting opposite to those measured by transducers 94 and 96.

By measuring the force applied by the user to the pedal 16 by virtue of transducers 96 and 94, it is possible to calculate work done by the user in extending the user's legs to push pedal 16 in a forward position, as well as power generated by the user in doing this work. Since microcomputer 82 will be able to do the calculations very rapidly, it will be possible to display the results on the video screen 20 so that the user will have in essence a real time display of his or her performance characteristics as a result of the pedal stroke previously performed. Information can be displayed in a variety of methods either as numerical data or preferably as a force versus time chart, work versus distance chart, or any other graphic display which will plot one of the results calculated or measured with the man/machine model against one of the other calculated or measured variables. Preferably, keyboard 84 may be used to select a variety of displays depending on the user's or therapist's desired information. Keyboard 84 may be conveniently located near seat 12 and video screen 20 so that the user may select desired output displays. Additionally, it is possible to display a graphical representation of the user limb in a computer-generated real time model which shows the limb moving through the extension of the pedal crank. Desired data can be displayed simultaneously with the computer-generated moving model of the user limb so that the user or therapist may be able to determine at what point of extension a user's limb is providing a certain output. This will help in pinpointing specific damaged tissue dependent upon the muscles used during a particular point of extension which will allow a therapist to concentrate therapy on those particular muscles in order to focus rehabilitative efforts on the specific area needed. Likewise, using diagnostic outputs from computer 82, it is possible to identify muscles which should be developed to achieve a desired performance capability, for example, an athlete which desires to have a more powerful extension throughout the full range of extension of the limb. Such information would be useful, for example, to a runner to determine a preferred rate of leg extension to obtain better performance.

SECOND EMBODIMENT EXERCISER SYSTEM

Referring to FIG. 12, an alternate embodiment of the present invention is shown. The exerciser apparatus 100 is used by a user who stands on frame 112 and grips handle 102 and pulls the handle in an upward manner. A typical exercise that would be used for the apparatus of FIG. 12 would be, for example, an upper arm curl. As the user curls his or her arms in toward the body, handle 102 will move in a direction upward and away from the apparatus in the general direction of the arrow F. As the handle moves as indicated, it will pull cable 104 which is in turn connected to piston 106 of pneumatic cylinder 120. Cable 104 is guided by guide rollers 108, 110 and 111 which are attached to frame 112 by supports 116, 114, and 118, respectively. It is easily seen that as handle 102 is pulled in the direction F, cable 104 pulls piston 106 downward within the pneumatic cylinder 120. Pneumatic cylinder housing 130 is attached to jack ram 126 by bracket 128 such that as jack 124 pushes ram 126 in an upward direction bracket 128 will cause cylinder housing 130 to move in an upward direction. Pneumatic cylinder 120 is slidably mounted to frame 112 by slidable mounting 122 for stability. A pneumatic fluid pump 132 which may be an air compressor provides pneumatic fluid to cylinder 120 through pneumatic line 134. A three-point link 138 is provided which includes a load modifier link 136 which can be movably mounted to frame 112 by force link mounting bracket 140. The forces imparted to or relieved from cable 104 by force link 136 may be varied by changing the length of the force link, the angle between the force link and the back of frame 112, or by changing the position of force link mounting bracket 140 on frame 112. The techniques and effect of varying the compression ratio of the pneumatic cylinder 120 by moving the cylinder housing 130, changing the pressure of the compressible fluid within the pneumatic cylinder by a pneumatic fluid supply source 132, and by changing the position of the three-point link 138 with respect to the force transmitting cable 104 are all similar to the techniques and effects described above for the lower extremity embodiment of the invention shown in FIG. 1.

The apparatus of FIG. 12 can be similarly instrumented as described for the apparatus shown in FIG. 1. However, for the upper arm embodiment of FIG. 12, rather than measuring lower leg anthropometrics, the measured parameters would be the distance between the user's foot and the user's shoulder, the distance between the user's shoulder and the user's elbow, and the distance between the user's elbow and wrist. In this way, a similar anthropometric model may be generated to calculate the kinematics and kinetics of the user. An X-Y force transducer can be configured into guide roller 108 to determine the angle formed by cable 104 between handle 102, guide roller 108, and the base of frame 112 These force transducers may be also used to determine the total force being applied by the user to the handle at any given time. Rotational positioning encoders on guide roller 108 can also be used to determine the rate of speed at which handle 102 is moving. Strain gauges may also be mounted in the cable between guide roller 111 and three-point link 138 as well as in the cable immediately before the handle 102 to determine the forces being imparted or absorbed by force link 136.

THIRD EMBODIMENT EXERCISER

With respect to FIG. 13, an alternate embodiment exerciser 162 of the invention is shown. In the embodiment of FIG. 13 the user lays on a bench 160 with his or her head positioned proximate to the bench press apparatus 162. The user will extend his or her arms and grasp handles 164. When the user pushes handles 164 in the upward direction indicated by the letter A crank arms 166 will move upward and will pivot about crank pivots 168. The end of the crank arms opposite from handles 164 are lever extensions 170 which will move in a downward direction as the handles move upwards by virtue of rotating about crank pivots 168. As lever extensions 170 move in a downward direction cable 172 will be pulled over roller guides 174 and 176 causing the piston 178 to be pulled in a downward direction from cylinder 180. By attaching the upper end of cylinder 180 to a jack 182 with a bracket 184 the cylinder can be moved in an upward direction relative to the piston 178 thus changing the compression ratio within the cylinder 180. It is understood that the lower end of cylinder 180 which moves independently from the cylinder housing will be anchored to the frame of the apparatus 162 causing the piston and lower portion of the cylinder to remain stationery with respect to the movable upper portion of cylinder 180. A three point link system 186 which operates in the manner described above for the apparatus of FIG. 1 and FIG. 12 can also be used in the apparatus of FIG. 13. Although not shown in FIG. 13, the apparatus may also be provided with a compressible fluid source allowing the amount of compressible fluid within the cylinder 180 to be varied and also to be supplemented when and if compressible fluid leaks from cylinder 180.

Operation

In the operation of the apparatus the user or a therapist will determine an initial set point which will be equivalent to a resistive force in the cylinders which will resist the input force from the user. With reference to FIG. 8 the user or therapist will enter the set point at keyboard or data entry station 84. Keyboard 84 is integrally connected to computer 82. Upon initiation of the set-up of the apparatus computer 82 will send a signal to solid state relay 142. The initiation signal from computer 82 will cause solid state relay 142 to open dump valves 144 and 146. While in FIG. 8 each cylinder is shown as having its own dump valve, it would be possible to connect cylinder 39 and cylinder 40 together to a common line with having a single dump valve. In the preferred embodiment of the invention where the pneumatic fluid used in the cylinders is airs dump valves 144 and 146 will open to the atmosphere allowing any air in cylinders 39 and 40 to be exhausted to the atmosphere thereby equalizing the pressure between the atmosphere and the cylinders. In an alternate embodiment where a fluid other than air is used as the pneumatic fluid the dump valves may dump the pneumatic fluid to a pneumatic fluid reservoir or recovery system. A pneumatic fluid accumulator 152 is disposed between air compressor 74 and the left and right cylinders 39 and 40, respectively. Accumulator 152 acts as a reservoir to provide make-up pneumatic fluid to the cylinders as pneumatic fluid may leak from the cylinders to the atmosphere. Additionally, accumulator 152 serves to minimize the operational cycling of the air compressor and also to absorb pressure differentials between the air compressor and the cylinders while the air compressor is in operation.

Disposed between the pneumatic fluid accumulator 152 and the left and right cylinders 39 and 40 are the one way or check valves 150 and 148, respectfully. Check valves 150 and 148 allow pneumatic fluid to flow from the reservoir or accumulator 152 into the cylinders and do not allow pneumatic fluid to flow from the cylinder back into the accumulator. In this manner, as pneumatic fluid seeps out of cylinders 39 and 40, a pressure differential is created between the accumulator 152 and the cylinder which is losing fluid. Because the pressure in the cylinder is lower, pneumatic fluid will be able to flow from the accumulator through the one way check valve 148 or 150 into the cylinder 40 or 39, respectively It can be seen that when dump valves 144 and 146 are open any fluid in cylinders 39 and 40 as well as any pneumatic fluid in reservoir 152 will be exhausted through the dump valves.

Differential pressure sensor 154 will compare the pressure within the accumulator 152 against the set point pressure as determined by the operator or therapist. Differential pressure sensor will send a signal indicating the pressure differential to computer 82. When the differential pressure sensed by sensor 154 falls below a predetermined point, computer 82 will send a signal to compressor relay 156 which will in turn activate compressor 74. Compressor 74 will operate to charge accumulator 152. As the accumulator is charged with pneumatic fluid the pressure will rise causing the differential pressure sensed by pressure sensor 154 to approach that of the set point entered in computer 82. Computer 82 is programmed such that when the differential pressure between the accumulator and the set point has decreased to a certain point, preferably, when the pressure in the accumulator has risen to or is slightly in excess of the set point pressure, computer 82 will send another signal to compressor relay 156 to disengage the air compressor 74.

As the user uses the apparatus there is a high probability that some of the pneumatic fluid in the cylinders will seep out past the holes around the piston shafts or around the rings between the cylinder housing and the piston, thus allowing the pressure within the cylinders to drop during use of the apparatus. As described above, when the pressure in the cylinders drop below a sufficient pressure to allow the one way check valves 148 or 150 to be operated, pneumatic fluid from the accumulator will flow into the cylinders thereby maintaining the pressure in the cylinders at the desired set point pressure. Since the accumulator pressure will be maintained by the system of the differential pressure sensor 154 and air compressor 74 as described above, the pressure within cylinders 39 and 40 will remain relatively stable, resulting in a consistent resistive pressure against the users feet transmitted from the cylinder to pedals 16.

When the user or therapist desires to reset the initial pressure in the cylinders to a higher or lower pressure the above process is repeated. Each time a new set point is selected the dump valves 146 and 144 will empty the accumulator and cylinders 39 and 40 so that they are at equilibrium with the atmosphere (or other compressible fluid reservoir pressure if the compressible fluid is other than air).

With reference to FIG. 1 in the operation of the machine once the cylinders have been charged to their initial pressure as described above, the user 11 will place his or her feet on pedals 16 and will move the pedals 16 in a forward direction away from seat 12 by extension of the leg. It should be noted that in the apparatus of the present invention the user may either extend both legs simultaneously or in alternating extension, similar to a bicycle exercise. Referring to FIG. 2, as pedal 16 and thus crank 18 move in a forward position linkage 52 will be caused to move generally in the same direction as the pedal thereby causing the piston 45 to move in a direction towards the rear or seat position end of the apparatus. Referring to FIG. 5, the variable volume chamber 50 will be charged with compressible fluid. As piston 45 moves to the right causing piston head 48 to move towards opening 51, the compressible fluid within the variable volume chamber 50 will be compressed. As described above, by varying the variable volume chamber 50 by moving cylinder housing 42 either to the left or right as shown in FIG. 5 the rate of pressure increase when piston head 48 moves to the right can be changed. Similarly, by changing the initial pressure in the variable volume chamber 50 by using the compressor, 74 a higher or lower initial resistance to the user input may be achieved. At the end of the extension of the user's leg, piston head 48 will be at its farthest position towards the right end of the pneumatic resistor 38 of FIG. 5. At this point as the user starts to release pressure on the pedal 16 by relaxing the leg muscles the compressed fluid in the variable volume chamber 50 will cause the piston head 48 to move in a leftward position causing piston shaft 44 to move in a similar direction thereby pulling linkage 52 in a rearward direction towards the seat 12 of the apparatus thus causing pedal 16 to move in a similar direction. When pedal crank 18 has reached the extent of its clockwise rotation about pedal crank pivot 28 as shown in FIG. 2 there will be no incremental force applied to the user's foot by pedal 16 and the apparatus will have returned to an "at rest" position, By applying known pressure/volume calculations using the ideal gas law it is possible to determine compression ratios and initial pressures of the compressible fluid in the pneumatic resistors 38 to achieve a desired performance curve of piston travel distance versus resistance imparted to the user (i.e., a "distance/resistance" performance curve). It is then possible to program this information into computer 82 such that a therapist or the user may select a desired performance curve. Likewise, the effect of three-point link 64 on the resultant force on first link 57 and the second link 58 can be determined by fundamental statics calculations. This information may then be combined with the distance/resistance information just described to produce more complex performance curves which may also be entered into computer 82. By connecting computer 82 to a drive system on the end of third link 64 where third link connects to third link mounting bracket 80, or where the third link mounting bracket connects to the frame 26, the three point link can be automatically adjusted to achieve a desired output selected from computer 82 by the user or therapist. An example of a drive system on third link 82 would be for example a rack and pinion gearing system allowing mounting bracket 80 to be moved in a forward and rearward direction on frame 27 or in an upward or downward direction. Likewise, by combining a rack and pinion gear system with a servo motor with a two part link replacing third link 64 it is possible to increase and shorten the length of third link 64.

Figure 3:
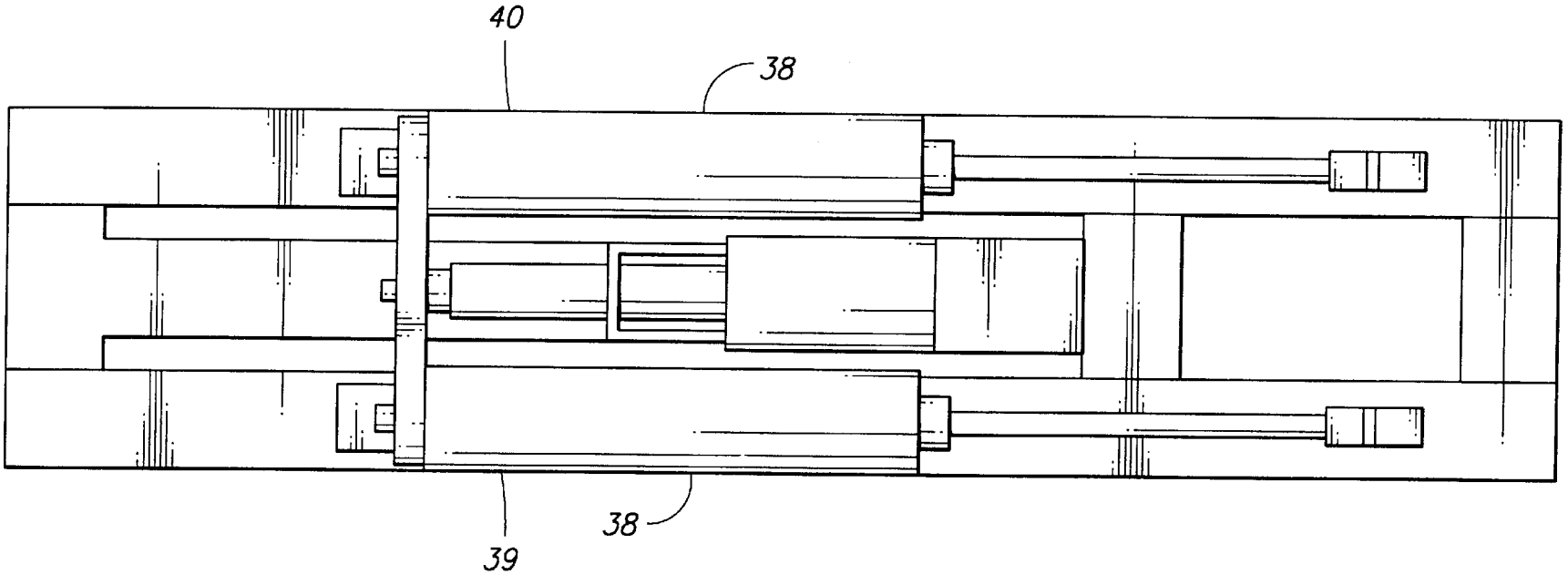
FIG. 3 is a plan view showing limited portions of the apparatus of FIG. 2.

Although the embodiments of the present invention are shown as having only one positioner 66 connected to a common cross bar 70 for positioning the cylinder housings of cylinders 39 and 40 as shown in FIG. 3, it is possible to have a separate jack or positioner dedicated to each cylinder. In this way the compression ratio of each cylinder may be adjusted independently of the other so that, for example, a user having difference strengths in each leg could exercise each leg at the same rate. Likewise, it is possible to configure the apparatus with two pneumatic compressors 74 to separately vary the initial pressure of the compressible fluid within each of the two cylinders.

Methods

The invention also includes novel methods. In one preferred aspect the novel methods relate to interactive physical exercise between a user and a physical fitness apparatus, such as exerciser 10. The methods include pressurizing a compressible fluid to a desired operational baseline pressure. The methods also include applying the baseline pressure to a loading device forming a part of the apparatus.

The methods also preferably include adjusting the loading rate which will result from displacement of the user interface. This adjusting of the loading rate can be accomplished by adjusting one or more load rate adjusters. In one form the adjusting can be effected by adjusting the compression ratio of the loading device. Adjustment of the compression ratio of the loading device can be accomplished by adjustably positioning a portion, such as the cylinder housing, relative to another portion, such as the piston, of the fluid working loading device.

The adjusting of loading rate can alternatively or additionally be effected by action of at least one load modifying link which shares force applied through the user interface between the adjustable fluid loading device and the modifying link or links being used.

The novel methods can further be defined to include engaging a user interface using a part of the user's body. The user also typically performs the methods by forcing the user interface to move. The forcing has a complementary resisting effect which resists movement of the user interface using the compressible fluid loading device. The resisting can also be accomplished by resisting using the load modifying link as a supplemental resistance to displacement of the user interface.

The novel methods can further include compressing the working fluid, such as in the working fluid chamber contained with the load resister.

The methods of this invention can still further include sensing or detecting a number of relevant operational and predetermined parameters. One such step is sensing force applied by the user to the user interface. This is advantageously accomplished at one or more sensing devices as needed to define the loading applied by the user. Additional sensing can be effected by sensing the baseline pressure such as by using sensor 154.

Another such step includes detecting one or more positional parameters of the user interface, such as by using encoders 88 and 90. Positional information can also be sensed from the seat position encoder 25.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A physical fitness apparatus comprising:

a frame having a first end and a second end;

a seat supported by said frame proximate to said first end of said frame;

a pedal crank having a first end and a second end, said first end of said pedal crank pivotally attached to said frame at a pedal crank pivot proximate to said second end of said frame;

a pedal, said pedal pivotally attached to said second end of said pedal crank at a pedal pivot;

a linkage having a first end and a second end, said linkage first end connected to said pedal crank;

a pneumatic cylinder comprising a piston and a housing, said piston and said housing defining a variable volume space, said pneumatic cylinder having a first end and a second end, said pneumatic cylinder first end connected to said linkage second end, said pneumatic cylinder second end being movably disposed with respect to said frame and independent of movement of said pneumatic cylinder first end to allow said variable volume space to be varied.

2. The apparatus of claim 1 further comprising a jack, said jack having a first end attached to said frame and a second end attached to said pneumatic cylinder second end.

3. The apparatus of claim 2 wherein said housing has a fluid inlet opening disposed therein, said fluid opening in fluid communication with a compressible fluid source.

4. The apparatus of claim 3 further comprising a compressible fluid accumulator disposed between, and in fluid communication with, said fluid inlet opening and said compressible fluid source.

5. The apparatus of claim 4 further comprising:

a first rotational position encoder configured and arranged to detect a rotational position of said pedal crank about said pedal crank pivot and produce a first electrical signal in response thereto;

a second rotational position encoder configured and arranged to detect a rotational position of said pedal about said pedal pivot and produce a second electrical signal in response thereto;

a longitudinal position encoder configured and arranged to detect a longitudinal position of said seat relative to said pedal crank pivot and produce a third electrical signal in response thereto; and at least one force transducer configured and arranged to detect component forces acting on said pedal pivot and produce a fourth electrical signal in response thereto.

6. The apparatus of claim 5 further comprising a computer configured to receive said electrical signals and calculate a velocity of said pedal, a resultant force on said pedal pivot, and a torque about said pedal crank pivot.

7. The apparatus of claim 6 further comprising:

a pressure sensor configured to sense baseline operating pressure and produce a pressure signal in response thereto;

a control system configured to receive said pressure signal and produce a first control signal in response thereto; and wherein said compressible fluid source comprises a compressor having an activation switch configured to receive said first control signal and actuate said compressor in response thereto.

8. The apparatus of claim 7 further comprising a dump valve in fluid communication with said variable volume space for releasing pressure within said variable volume space, said dump valve configured to actuate in response to a second control signal.

9. The apparatus of claim 7 wherein said first control signal may be varied to allow said compressor activation switch to actuate in response to differing preselected values of said pressure signal.

10. The apparatus of claim 6 wherein said computer further comprises a user dynamics program configured to receive inputs describing certain predetermined parameters of said apparatus and said user and generate resultant mathematical models thereof, said user dynamics program comprising an inverse dynamics program for using said mathematical models in conjunction with said velocity of said pedal, said resultant force on said pedal pivot, and said torque about said pedal crank pivot to calculate user dynamics comprising forces acting on certain preselected points of said user and user velocities and accelerations of certain preselected points of said user.

11. The apparatus of claim 10 further comprising:

a local data readout in communication with said computer for displaying said user dynamics; and a warning annunciator in communication with said computer for announcing user dynamics which exceed a predetermined value.

12. The apparatus of claim 1 further comprising a compressible fluid source for supplying compressible fluid to the pneumatic cylinder.

13. The apparatus of claim 1 further comprising a compressible fluid source for supplying compressible fluid to the pneumatic cylinder, and wherein said housing has a fluid inlet opening disposed therein which is in fluid communication with the compressible fluid source.

14. The apparatus of claim 1 further comprising at least one positional encoder connected to detect the position of said pedal crank.

15. The apparatus of claim 1 further comprising at least one positional encoder connected to detect the position of said pedal.

16. The apparatus of claim 1 further comprising at least one force transducer for detecting force applied by a user.

17. The apparatus of claim 1 further comprising at least one longitudinal position encoder for detecting the position of said seat.

18. The apparatus of claim 1 further comprising at least one sensor for providing data indicating operating conditions of the apparatus.

19. A physical fitness apparatus, comprising:

a frame;

a user interface movably mounted with respect to said frame, said user interface configured to move in response to force input from a user; wherein said user interface moves through a plurality of positions in response to said force input;

a compressible fluid resister comprising a first component and a second component, said first component and said second component movably disposed with respect to one another to form a sealed, variable volume chamber therebetween, wherein said first component is coupled to said user interface and is configured to move relative to said second component in response to movement of said user interface, and said second component is movably disposed relative to said frame independent of movement of said first components;

a first position sensor configured and arranged to detect said positions of said user interface and produce a first signal in response thereto;

a second position sensor configured and arranged to detect a position of a predetermined physiological feature of said user and produce a second signal in response thereto; and a force sensor configured and arranged to detect a force acting on said user interface and produce a third signal in response thereto;

a computer configured to receive said signals and calculate velocities of said user interface positions and a resultant force on said user interface; said computer including a program configured to receive spatial data pertaining to said apparatus and said user, said velocities of said user interface positions and said resultant force on said user interface, and calculate user kinetics and kinematics using said spatial data and said velocities and said resultant force.

20. The apparatus of claim 19 further comprising a positioner, said positioner configured to move said compressible fluid resister second component relative to said frame.

21. The apparatus of claim 19 further comprising a powered compressible fluid prime mover in fluid communication with said variable volume chamber for adding compressible fluid thereto.

22. The apparatus of claim 19 further comprising a data output display in communication with said computer.

23. The apparatus of claim 21 further comprising a pressure control system for sensing pressure within said variable volume chamber and activating said powered compressible fluid prime mover in response to a predetermined pressure within said variable volume chamber.

24. The apparatus of claim 19 further comprising a compressible fluid reservoir in fluid communication with said variable volume chamber for adding compressible fluid thereto.

25. The apparatus of claim 13 further comprising a compressible fluid accumulator in fluid communication with said fluid inlet opening and said compressible fluid source.

* * * * *

UNITED STATES PATENT AND TRADEMARK OFFICE

CERTIFICATE OF CORRECTION

PATENT NO. : 5,890,996

DATED : April 6, 1999

INVENTOR(S) : Frame et al.

It is certified that error appears in the above-identified patent and that said Letters Patent is hereby corrected as shown below:

Column 11, line 27, after "$V_l$", delete [;].

Column 11, line 37, after "quantity", delete [($D_1$_)] and replace with - - ($D_1$-$l$) - -.

Column 13, line 40, after "considerations", insert - - . - - .

Column 15, line 12, after "parameters", insert - - . - - .

Column 15, line 24, after "Display", insert - - 20 - - .

Column 15, line 67, delete [geometries] and replace with - - geometrics - - .

Column 18, line 31, after "112", insert - - . - - .

Column 19, line 21, after "is" delete [airs] and replace with - - air - - .

Column 19, line 49, after "respectively", insert - - . - - .

UNITED STATES PATENT AND TRADEMARK OFFICE

CERTIFICATE OF CORRECTION

PATENT NO. : 5,890,996
DATED : April 6, 1999
INVENTOR(S) : Frame et al.

It is certified that error appears in the above-identified patent and that said Letters Patent is hereby corrected as shown below:

Column 24, line 23, delete [components] and replace with - - component - -.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 5,890,996
DATED : April 6, 1999
INVENTOR(S) : Frame et al.

It is certified that error appears in the above-identified patent and that said Letters Patent is hereby corrected as shown below:

Column 11,
Line 27, after "$V_l$", delete [;].
Line 37, after "quantity", delete [($D_1$_)] and replace with -- ($D_1$-$l$) --.

Column 13,
Line 40, after "considerations", insert -- . --.

Column 15,
Line 12, after "parameters", insert -- . --.
Line 24, after "Display", insert -- 20 --.
Line 67, delete [geometries] and replace with -- geometrics --.

Column 18,
Line 31, after "112", insert -- . --.

Column 19,
Line 21, after "is" delete [airs] and replace with -- air --.
Line 49, after "respectively", insert -- . --.

Column 24,
Line 23, delete [components] and replace with -- component --.

Signed and Sealed this

Ninth Day of October, 2001

*Attest:*

Nicholas P. Godici

*Attesting Officer*

NICHOLAS P. GODICI
*Acting Director of the United States Patent and Trademark Office*